US012484655B2

(12) United States Patent
Livne et al.

(10) Patent No.: US 12,484,655 B2
(45) **Date of Patent: *Dec. 2, 2025**

(54) FOOTWEAR HAVING AN OUTSOLE FOR MANIPULATING A GAIT PARAMETER OR AMELIORATE A LOWER LIMB PATHOLOGY

(71) Applicant: APOS MEDICAL ASSETS LTD., Tel Aviv (IL)

(72) Inventors: Oren Livne, Tel Aviv (IL); Clifford Bleustein, Purchase, NY (US); Ganit Segal, Modiin-Macabim-Reut (IL); Shirley Shema, Pardes-Chana (IL)

(73) Assignee: APOS MEDICAL ASSETS LTD., Tel Aviv (IL)

( * ) Notice: Subject to any disclaimer, the term of this patent is extended or adjusted under 35 U.S.C. 154(b) by 0 days.

This patent is subject to a terminal disclaimer.

(21) Appl. No.: 18/293,053

(22) PCT Filed: Jul. 28, 2022

(86) PCT No.: PCT/IL2022/050825

§ 371 (c)(1),
(2) Date: Jan. 29, 2024

(87) PCT Pub. No.: WO2023/007501

PCT Pub. Date: Feb. 2, 2023

(65) Prior Publication Data

US 2024/0341400 A1 Oct. 17, 2024

Related U.S. Application Data

(63) Continuation-in-part of application No. 17/585,997, filed on Jan. 27, 2022, now Pat. No. 11,896,078.

(60) Provisional application No. 63/226,790, filed on Jul. 29, 2021.

(51) Int. Cl.
*A43B 7/1415* (2022.01)
*A43B 13/36* (2006.01)

(52) U.S. Cl.
CPC ..... *A43B 7/1415* (2013.01); *A43B 13/36* (2013.01)

(58) Field of Classification Search
None
See application file for complete search history.

(56) References Cited

U.S. PATENT DOCUMENTS

| | | | |
|---|---|---|---|
| 1,021,142 | A | 3/1912 | Freeman |
| 1,061,353 | A | 5/1913 | Block |
| 1,736,576 | A | 11/1929 | Cable |
| 2,096,500 | A | 10/1937 | Mccahan et al. |

(Continued)

FOREIGN PATENT DOCUMENTS

| | | | |
|---|---|---|---|
| AU | 2005262198 | A1 | 1/2006 |
| CA | 2340124 | A1 | 11/2000 |

(Continued)

*Primary Examiner* — Jila M Mohandesi
(74) *Attorney, Agent, or Firm* — The Roy Gross Law Firm, LLC; Roy D. Gross

(57) ABSTRACT

The present invention provides an outsole, comprising, at least one recess located at a ground engaging or outer surface of the outsole and having: (a) a depth of between 10% to 95% of the maximum thickness of the outsole; and (b) an area that covers between 10% to 95% of the entire ground engaging or outer surface of the outsole.

20 Claims, 8 Drawing Sheets

(56) References Cited

U.S. PATENT DOCUMENTS

| | | | | |
|---|---|---|---|---|
| 2,133,302 | A | 10/1938 | Mccormick | |
| 2,311,925 | A | 2/1943 | Boos | |
| 2,518,033 | A | 8/1950 | Wilbert | |
| 3,082,549 | A | 3/1963 | Dolceamore | |
| 3,402,485 | A | 9/1968 | Mcmorrow | |
| 3,526,976 | A | 9/1970 | Jacobs | |
| 3,552,043 | A | 1/1971 | Moffa | |
| 3,782,011 | A | 1/1974 | Fisher | |
| 3,916,538 | A | 11/1975 | Loseff | |
| 3,940,128 | A | 2/1976 | Ragone | |
| 4,030,213 | A | 6/1977 | Daswick | |
| 4,071,963 | A | 2/1978 | Fukuoka | |
| 4,176,459 | A | 12/1979 | Perser et al. | |
| RE31,173 | E | 3/1983 | Daswick | |
| 4,586,706 | A | 5/1986 | Chen | |
| 4,739,986 | A | 4/1988 | Kucharik et al. | |
| 4,805,320 | A | 2/1989 | Goldenberg et al. | |
| 4,821,432 | A | 4/1989 | Reiber | |
| 4,841,648 | A | 6/1989 | Shaffer et al. | |
| 4,892,090 | A | 1/1990 | Kaeser | |
| 4,907,355 | A * | 3/1990 | Allen | A43B 5/14 36/131 |
| 5,014,706 | A | 5/1991 | Philipp | |
| 5,188,578 | A | 2/1993 | Voigt | |
| 5,203,321 | A | 4/1993 | Donovan et al. | |
| 5,251,508 | A | 10/1993 | Robbins | |
| 5,337,494 | A | 8/1994 | Ricker | |
| 5,400,528 | A | 3/1995 | Skinner et al. | |
| 5,518,476 | A | 5/1996 | McLeon | |
| 5,533,282 | A | 7/1996 | Kataoka et al. | |
| 5,584,787 | A | 12/1996 | Guidry | |
| 5,603,334 | A | 2/1997 | Sharp | |
| 5,647,145 | A | 7/1997 | Russell et al. | |
| 5,685,807 | A | 11/1997 | Tong et al. | |
| D394,343 | S | 5/1998 | Marshall et al. | |
| 5,848,954 | A | 12/1998 | Stearns | |
| 5,897,464 | A | 4/1999 | Mcleod | |
| 5,902,214 | A | 5/1999 | Makikawa et al. | |
| 6,108,944 | A | 8/2000 | Savoie | |
| 6,115,943 | A | 9/2000 | Gyr | |
| D439,733 | S | 4/2001 | Savoie | |
| 6,283,897 | B1 | 9/2001 | Patton | |
| D448,920 | S | 10/2001 | Montross et al. | |
| 6,311,416 | B1 | 11/2001 | Cohen | |
| 6,315,786 | B1 | 11/2001 | Smuckler | |
| 6,349,487 | B1 | 2/2002 | Hice | |
| 6,519,873 | B1 | 2/2003 | Buttigieg | |
| 6,557,272 | B2 | 5/2003 | Pavone | |
| D482,851 | S | 12/2003 | McClaskie | |
| 6,692,419 | B2 | 2/2004 | Chen | |
| 6,742,289 | B2 | 6/2004 | Celmo | |
| 6,792,703 | B2 | 9/2004 | Cohen | |
| 6,811,523 | B1 | 11/2004 | Timmer | |
| 6,880,267 | B2 | 4/2005 | Smaldone et al. | |
| 6,979,287 | B2 | 12/2005 | Elbaz et al. | |
| 7,004,895 | B2 | 2/2006 | Perry et al. | |
| 7,101,330 | B2 | 9/2006 | Elbaz et al. | |
| 7,165,343 | B2 | 1/2007 | Fukui | |
| 7,287,340 | B2 | 10/2007 | Talbott | |
| 7,373,740 | B2 | 5/2008 | Lo | |
| 7,500,324 | B1 | 3/2009 | Power et al. | |
| 7,621,057 | B1 | 11/2009 | Julian et al. | |
| 7,707,751 | B2 | 5/2010 | Avent et al. | |
| D648,517 | S | 11/2011 | Vestuti et al. | |
| 8,713,817 | B2 * | 5/2014 | Litchfield | A43B 21/285 36/35 B |
| 8,758,207 | B2 * | 6/2014 | Elbaz | A63B 23/04 482/79 |
| 8,959,798 | B2 | 2/2015 | Pfister | |
| 9,357,812 | B2 | 6/2016 | Elbaz et al. | |
| 9,861,509 | B2 | 1/2018 | Elbaz et al. | |
| 10,010,743 | B2 | 7/2018 | Elbaz et al. | |
| 10,750,812 | B2 | 8/2020 | Mor et al. | |
| 2002/0038522 | A1 | 4/2002 | Houser et al. | |
| 2002/0100190 | A1 | 8/2002 | Pellerin | |
| 2002/0166258 | A1 | 11/2002 | Posa | |
| 2003/0188458 | A1 | 10/2003 | Kelly | |
| 2006/0021260 | A1 * | 2/2006 | Kim | A43B 21/39 36/130 |
| 2006/0196087 | A1 | 9/2006 | Sellers et al. | |
| 2007/0051020 | A1 | 3/2007 | Tajima et al. | |
| 2007/0079532 | A1 | 4/2007 | Ramirez | |
| 2007/0271816 | A1 * | 11/2007 | Workman | A43B 13/24 36/15 |
| 2008/0134541 | A1 | 6/2008 | Bar-Haim et al. | |
| 2008/0263898 | A1 | 10/2008 | Gueh | |
| 2011/0047831 | A1 | 3/2011 | Elbaz et al. | |
| 2011/0126422 | A1 * | 6/2011 | Vattes | A43B 13/145 36/28 |
| 2013/0116726 | A1 | 5/2013 | Mor et al. | |
| 2013/0196829 | A1 | 8/2013 | Elbaz et al. | |
| 2015/0165690 | A1 | 6/2015 | Tow | |
| 2017/0066196 | A1 | 3/2017 | Beard et al. | |
| 2018/0085055 | A1 | 3/2018 | Annoni et al. | |
| 2018/0279915 | A1 | 10/2018 | Huang et al. | |
| 2023/0000396 | A1 | 1/2023 | Coffey et al. | |

FOREIGN PATENT DOCUMENTS

| | | | |
|---|---|---|---|
| CN | 101279636 | A | 10/2008 |
| CN | 113453576 | A | 9/2021 |
| JP | 2013534446 | A | 9/2013 |
| JP | 2016501114 | A | 1/2016 |
| KR | 20050039686 | A | 4/2005 |
| KR | 20150001713 | A | 1/2015 |
| KR | 20190107155 | A | 9/2019 |
| RU | 2343946 | C2 | 1/2009 |
| WO | 2016199150 | A1 | 12/2016 |
| WO | 2020121314 | A1 | 6/2020 |

* cited by examiner

FOOTWEAR HAVING AN OUTSOLE FOR MANIPULATING A GAIT PARAMETER OR AMELIORATE A LOWER LIMB PATHOLOGY

CROSS REFERENCE TO RELATED APPLICATIONS

This application is a National Phase of PCT Patent Application No. PCT/IL2022/050825 having International filing date of Jul. 28, 2022, which claims priority of U.S. patent application Ser. No. 17/585,997, filed Jan. 27, 2022 and also claims the benefit of priority of U.S. Provisional Patent Application No. 63/226,790, filed Jul. 29, 2021 titled: "FOOTWEAR HAVING AN OUTSOLE FOR MANIPULATING A GAIT PARAMETER OR AMELIORATE A LOWER LIMB PATHOLOGY", the contents of which are hereby incorporated by reference in their entirety.

FIELD OF INVENTION

This invention is directed to, inter alia, a footwear, which includes at least one protuberance, wherein the location and structure of the at least one protuberance affects at least one gait parameter.

BACKGROUND OF THE INVENTION

Human gait depends on a complex interplay of major parts of the nervous, musculoskeletal and cardiorespiratory systems. The individual gait pattern is influenced by, the musculoskeletal structure, posture, diseases affecting the musculoskeletal structure, neurological factors affecting the musculoskeletal structure and posture, age, personality, mood and sociocultural factors.

The preferred walking speed in older adults is a sensitive marker of general health and survival. Safe walking requires intact cognition and executive control. Gait disorders lead to injuries, falls, disabilities, loss of personal freedom, and injuries and result in a marked reduction in the quality of life (Pirker W, Katzenschlager R. Gait disorders in adults and the elderly. Wiener Klinische Wochenschrift. 2017 Feb. 1; 129 (3-4): 81-95).

Gait Analysis of each component of the three phases of ambulation is an essential part of the diagnosis of various neurologic disorders, various orthopedic diseases, and the assessment of patient progress during rehabilitation and recovery from the effects of neurologic disease, a musculoskeletal injury, or disease process, or amputation of a lower limb.

The demarcation between walking and running occurs when periods of double support during the stance phase of the gait cycle (both feet are simultaneously in contact with the ground) give way to two periods of double float at the beginning and the end of the swing phase of gait (neither foot is touching the ground, Novacheck T F. The biomechanics of running. Gait and Posture 7 (1998) 77-95).

The sequences for walking that occur may be summarized as follows (Vaughan C L. Theories of bipedal walking: an odyssey. J Biomech 2001; 36 (2003): 513-523): Registration and activation of the gait command within the central nervous system; Transmission of the gait systems to the peripheral nervous system; Contraction of muscles; Generation of several forces; Regulation of joint forces and moments across synovial joints and skeletal segments; Generation of ground reaction forces.

The normal forward step consists of two phases: stance phase; swing phase. The Stance phase occupies 60% of the gait cycle, during which one leg and foot are bearing most or all of the bodyweight. The Swing phase occupies only 40% of it, during which the foot is not touching the walking surface and the bodyweight is borne by the other leg and foot (Loudon J, et al. The clinical orthopedic assessment guide. 2nd ed. Kansas: Human Kinetics, 2008. p. 395-408).

In a complete two-step cycle both feet are in contact with the floor at the same time for about 25 percent of the time. This part of the cycle is called the double-support phase. Gait cycle phases: the stance phase and the swing phase and involves a combination of open and close chain activities (Shultz S J et al. Examination of musculoskeletal injuries. 2nd ed, North Carolina: Human Kinetics, 2005. p 55-60).

Sports injuries are an unavoidable part of sports. Understanding the challenge in injury prevention is to recognize all the risk factors and musculoskeletal patterns for specific injuries in each sport and create better prevention strategies. One of the key factors in injury prevention and post-injury rehabilitation is proprioception and neuromuscular control. Such a control can be achieved by gait manipulation.

There is a need for devices and methods that can manipulate gait, differentially induce lower-limb muscles, treat neurological conditions, treat and reduce pain derived from the lower limbs, treat orthopedic conditions, improve neurological and muscular control and/or improve/reduce the outcomes thereof, and outcomes related to the sensory system, the motor system and/or the overall movement, walking and/or running.

SUMMARY OF THE INVENTION

In one embodiment, the present invention provides an outsole, comprising, at least one recess located at a ground engaging or outer surface of the outsole and having: (a) a depth of between 10% to 95% of the maximum thickness of the outsole; and (b) an area that covers between 10% to 95% of the entire ground engaging or outer surface of the outsole.

In one embodiment, a perimeter of the at least one recess delineates a base of adapted to be enclosed within one or more protuberances. In one embodiment, an outer contour of the one or more protuberances and an outer contour of the outsole forms a continuous curvature. In one embodiment, at least 50% of a base of base area of the one or more protuberances are delineated by the at least one recess. In one embodiment, a base of a single protuberance occupies at least 60% of an area of a single recess and a first perimeter of said base of said single protuberance is adapted to fit a second perimeter of said single recess.

In one embodiment, each of said one or more protuberances comprise a peak and a base, wherein said peak is higher in at least 10% than a maximum depth of said at least one recess, and wherein said one or more protuberances are adapted to be removably attached to said at least one recess/indentation/cavity. In one embodiment, said one or more protuberances is two protuberances.

In one embodiment, a ground-engaging surface of said one or more protuberances extends from said at least one recess when said one or more protuberances are placed in said at least one recess.

In one embodiment, a posterior portion of the at least one recess is adapted to match a posterior protuberance and an anterior portion of the at least one recess is adapted to match an anterior protuberance. In one embodiment, the outsole has a posterior recess which is adapted to match a posterior protuberance and an anterior recess which is adapted to match an anterior protuberance.

In one embodiment, the outsole is by a shore hardness of between 20 Sh-00 to 80 Sh-D. In one embodiment, the outsole further comprises a layer, contacting at least a portion of the at least one recess. In one embodiment, the layer has a shore hardness of between 20 Sh-A to 90 Sh-D.

In one embodiment, said layer has a shore hardness which is at least 5% higher than said outsole shore hardness.

Some aspects of the invention are related to footwear or a footwear kit for manipulating a gait parameter, comprising, an outsole according to any one of the embodiments disclosed herein. The footwear or a footwear kit further includes two curved protuberances, protruding out from said ground engaging or outer surface of said outsole, and adapted to be removably attached to said at least one recess, wherein each protuberance has a different curved outer contour.

In some embodiments, the two curved protuberances are asymmetrical. In some embodiments, the two curved protuberances are defined by a variety of arches of different radiuses which are tangent to each other. In some embodiments, an outer contour of at least one of said two curved protuberances and an outer contour of said outsole form a continuous curvature. In some embodiments, each curved protuberance comprises a portion connectable to the recess and a ground-engaging portion, wherein the portion connectable to the recess is harder than the ground-engaging portion.

In some embodiments, each protuberance is different with respect to at least a location of the peak, a convexity, shore-hardness, or any combination thereof. In some embodiments, a base of a single protuberance occupies at least 60% of an area of a single recess and a first perimeter of said base of said single protuberance is adapted to fit a second perimeter of said single recess.

In some embodiments, for each protuberance at least a location of a peak is determined based on at least one gait parameter and/or the balance parameter of the subject measured for a group of subjects. In some embodiments, the at least one gait parameter is selected from: foot alignment, knee alignment, velocity, swing and stance phase, double support time, ground reaction forces, impulse, propulsion during habitual walking, kneed alignment, center of pressure, symmetry, gait speed, step time, step length, stride length, step width, foot angle, demarcation between walking and running. In some embodiments, the group of subjects are determined as subjects having at least two common characteristics, selected from, age, gender, foot size, gait behavior and pathology. In some embodiments, a group of subjects is defined as subjects having a deficiency in 1, 2, 3, 4, 5, 5, 6, 7, 8, 9, 10 or any range therebetween, common gait parameter/s. In some embodiments, subjects having the common gait behavior are subjects having at least two similar gait parameters. In some embodiments, for each protuberance a curvature of the protuberance is determined based on the at least one gait parameter and/or the balance parameter of the subject measured for the group of subjects. In some embodiments, for each protuberance a contour of a base of the protuberance is determined based on the at least one gait parameter and/or the balance parameter of the subject measured for the group of subjects.

BRIEF DESCRIPTION OF THE DRAWINGS

The present invention will be understood and appreciated more fully from the following detailed description taken in conjunction with the appended drawings in which.

DETAILED DESCRIPTION OF THE INVENTION

Figure 1B:
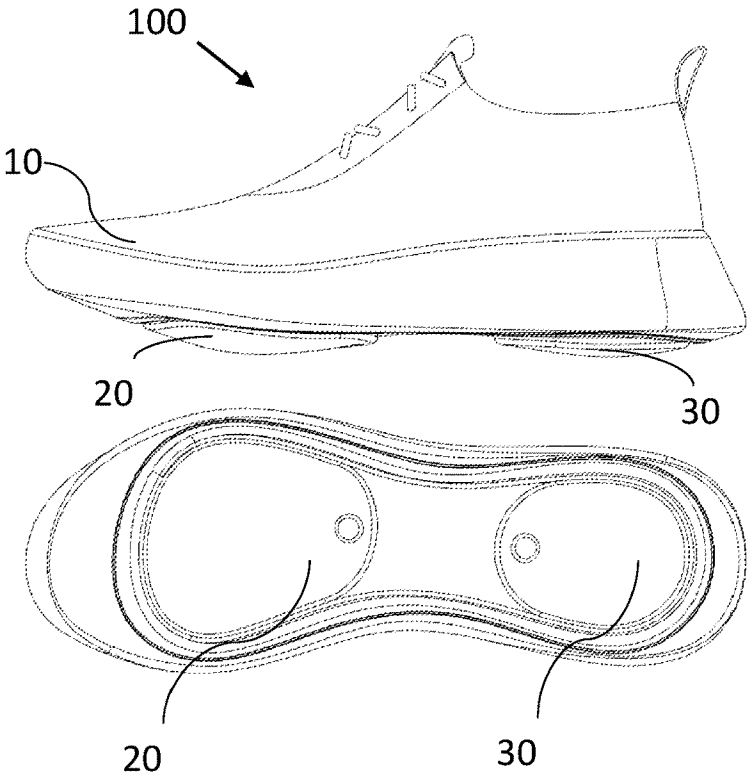
FIGS. 1A-1D are illustrations of a footwear, an assembled footwear, and two kits according to some embodiments of the invention.

Some aspects of the invention are directed to an outsole of footwear. The outsole is configured to receive specially designed one or more protuberances. In some embodiments, the outsole is fitted to accommodate and fix thereto, one or more protuberances. In one embodiment, "fitted to accommodate" is by means of at least one recess in the outsole. In one embodiment, the outsole may include at least one recess located at a ground engaging or an outer surface of the outsole and having: (a) a depth of between 10% to 95% of the maximum thickness of the outsole; and (b) an area that covers between 10% to 95% of the entire ground engaging or outer surface of the outsole.

As used herein, a recess is defined as any open cavity, indentation, etc. located at the ground engaging or outer surface of the outsole.

Some aspects of the invention are directed to a footwear comprising the outsole. The footwear may include additional components, such as, upper, midsole, insole, attachable and/or detachable protuberance, etc.

Some aspects of the invention are directed to a "kit" which includes the footwear and at least one set of separate one or more protuberances. The protuberances can be assembled inside at least one recess to form an "assembled footwear". In such case, the assembled footwear comprises the one or more protuberances fixed to an outer surface of the outsole as described herein. Some aspects of the invention are directed to a "kit" which includes the outsole and the upper shoes portion of a footwear. Some aspects of the invention are directed to a "kit" which includes the outsole and the upper shoes portion of a footwear and at least one set of separate one or more protuberances.

In another embodiment, the one or more protuberances, assembled in the assembled footwear, are configured to manipulate at least one gait parameter in a subject. In an embodiment, provided herein the assembled footwear comprising a protuberance fixed to an outer surface of the outsole as described herein is configured to manipulate the balance of a subject. In an embodiment, provided herein the assembled footwear is configured to manipulate proprioception, kinesthesia, or both of a subject in need thereof. In an embodiment, provided herein the assembled footwear comprising a protuberance fixed to an outer surface of the outsole as described herein is configured to treat a subject afflicted with a lower limb joint pathology such as but not limited to degenerative joint diseases and musculoskeletal traumas of the lower limb. In an embodiment, provided herein the assembled footwear comprising a protuberance fixed to an outer surface of the outsole as described herein is configured to treat other pathologies discussed herein.

In one embodiment, the assembled one or more protuberances are fixed and/or attached to the footwear. In one embodiment, the assembled one or more protuberances are fixed and/or attached to the outsole. In one embodiment, the assembled one or more protuberances are fixed and/or attached to the outsole within the recess. In one embodiment, the assembled one or more protuberances are detachable from the footwear, the outsole and/or recess. In one embodiment, the assembled one or more protuberances are replaceable.

In another embodiment, the one or more protuberances to be assembled in the at least one recess may have a therapeutic effect as described herein.

The Footwear, the Assembled Footwear and the Kit

Reference is made to FIGS. 1A, 1B, 1C and 1D which are illustrations of a footwear, an assembled footwear and two kits according to some embodiments of the invention.

Figure 1A:
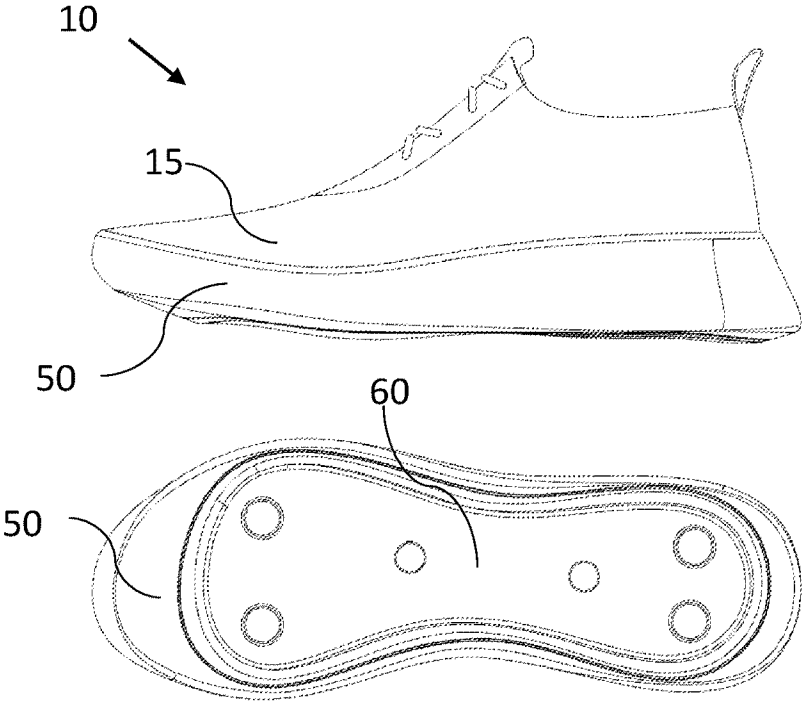

A footwear such as footwear 10, illustrated in FIG. 1A, may include at least an upper 15 and an outsole 50 according to embodiments of the invention. In some embodiments, outsole 50 includes at least one recess 60 adapted to fit or enclosed within one or more protuberances, for example, protuberances 20 and/or 30 or protuberance 25 illustrated in FIG. 1D.

In another embodiment, assembled footwear 100, illustrated in FIG. 1B, includes footwear 10 and one or more protuberances 20 and/or 30.

Figure 1D:
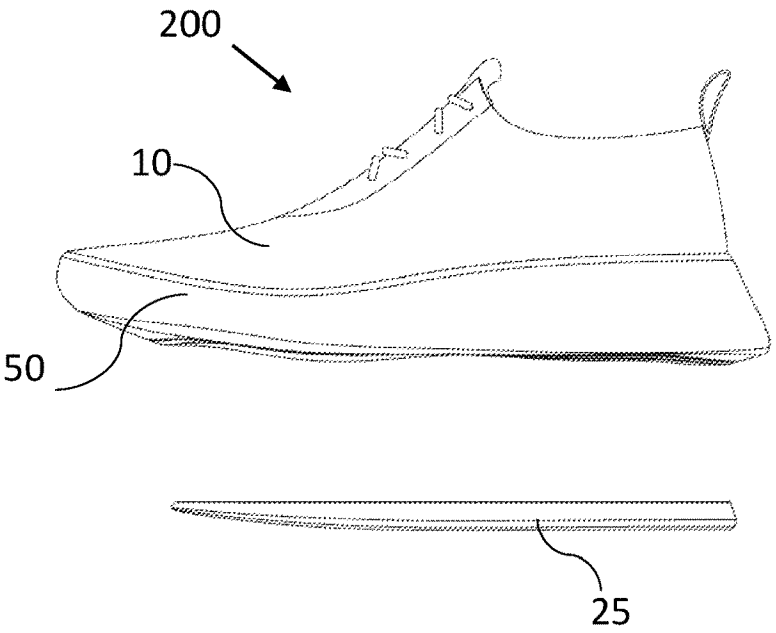
Figure 1C:
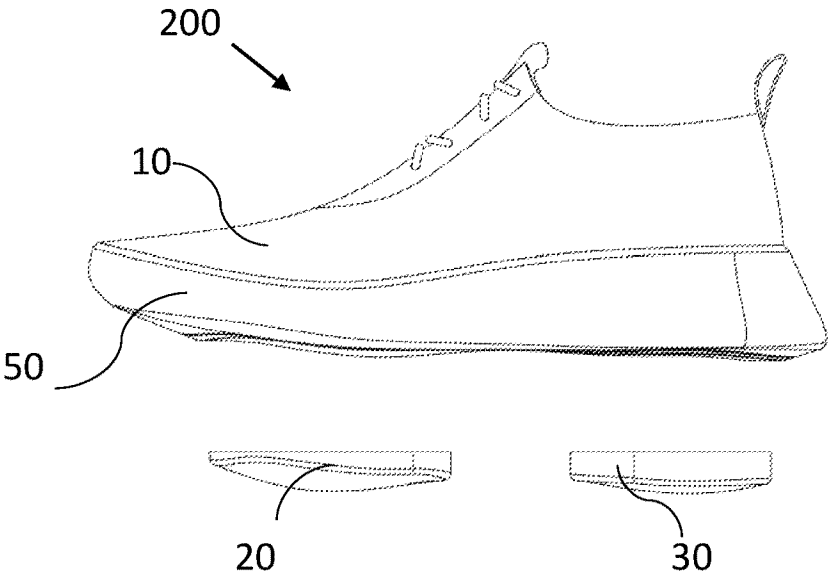

In another embodiment, a kit 200 comprising a disassembled footwear, is illustrated in FIG. 1C. Kit 200 comprises footwear 10 and a set of one or more protuberances 20 and/or 30. In another embodiment, a kit comprises separately a protuberance and a footwear. In another embodiment, a disassembled footwear or a kit comprises separately an outsole and an upper shoe portion, wherein the upper shoe portion is adapted to be assembled to the outsole. In another embodiment, a disassembled footwear or a kit comprises, separately, an outsole, an upper shoe portion and a protuberance.

In another embodiment, kit 200 comprising a disassembled footwear with a single protuberance, is illustrated in FIG. 1D. Kit 200 comprises footwear 10 and a separate single protuberance 25. Single protuberance 25 may be a substantially flat protuberance, as illustrated and discussed hereinbelow. Alternatively, single protuberance 25 is a bulbous protuberance, (e.g., protuberance 20 or 30). A single bulbous protuberance may be assembled in an anterior portion of recess 60, a middle portion of recess 60 and/or a posterior portion of recess 60.

In another embodiment, kit 200 may include two substantially flat protuberances to be assembled in two or more separate recesses or in a single recess.

In another embodiment, a kit or footwear comprises only flat protuberance or protuberances.

In another embodiment, a kit 200 may include two or more sets of alternative protuberances to be easily replaced by the subject. In another embodiment, kit 200 may include footwear 10, a set of functional protuberances, such as, protuberances 20 and 30 and at least one additional protuberance 25. As used herein, a functional protuberance is defined as a protuberance that is configured to manipulate at least one gait parameter and/or the balance parameters of the subject.

In another embodiment, the at least one additional protuberance 25 is assembled in at least one recess 60 for regular walking, standing or running.

The Outsole

Figure 2C:
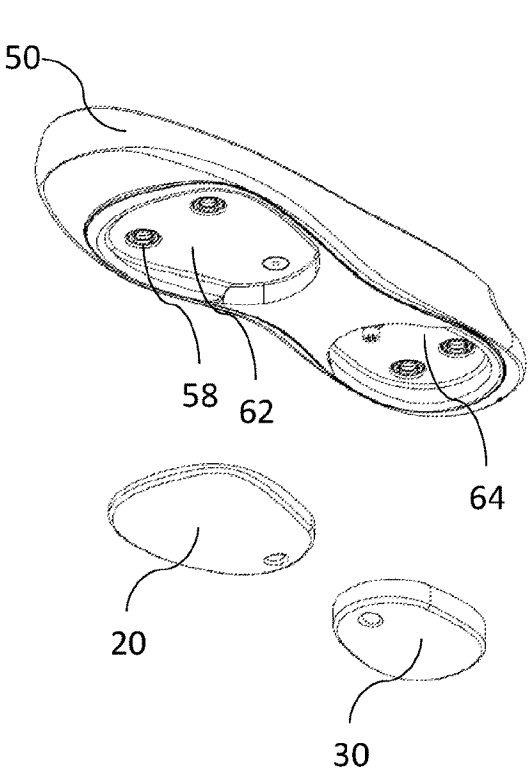
FIGS. 2A-2C are bottom-view illustrations, respectively, of an outsole and outsoles and perturbances according to some embodiments of the invention.
Figure 2B:
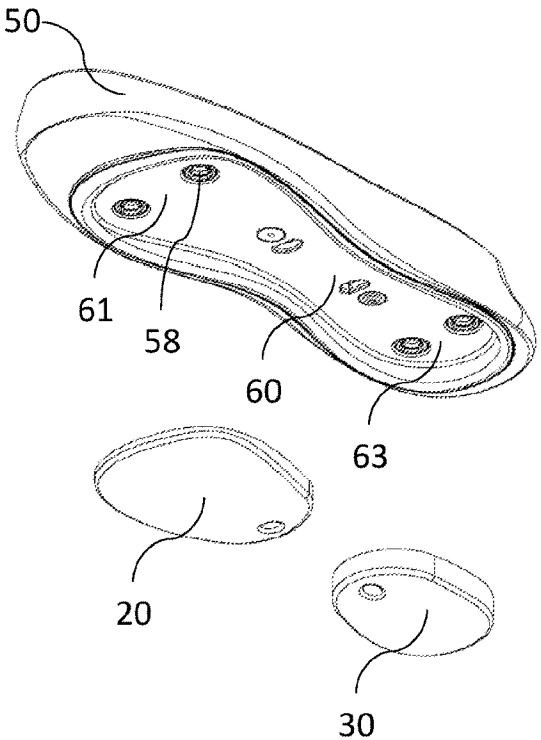
Figure 2A:
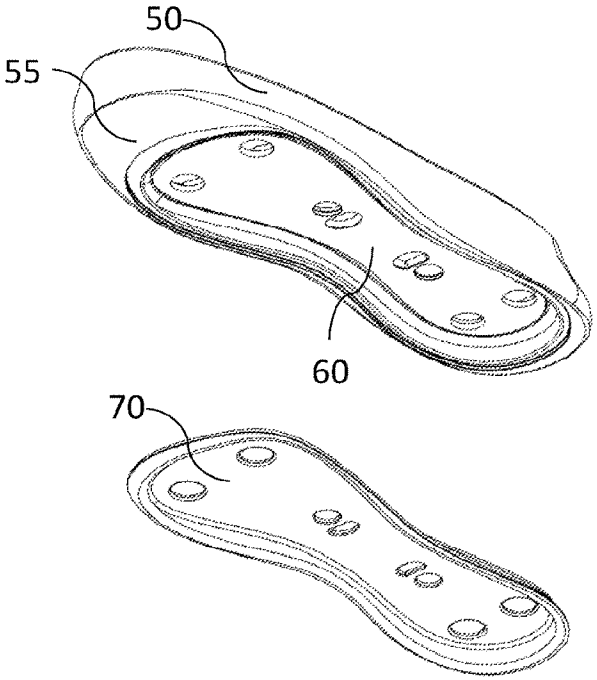

Reference is now made to FIGS. 2A, 2B, and 2C which are bottom-view illustrations, respectively, of an outsole and outsoles and perturbances according to some embodiments of the invention.

In another embodiment, outsole 50 includes at least one recess 60 located at a ground engaging, a bottom part, or an outer surface 55 of outsole 50. Outsole 50 may be made from any material known in the art which is suitable for forming an outsole. In an embodiment, outsole 50 includes a polymer or similar material characterized by a shore hardness of between 20 Sh-00 to 80 Sh-D.

In an embodiment, outsole 50 is made from a single piece having a uniform hardness. For example, outsole 50 may be injected, extruded, cast, pressed, etc., from a single polymer. In another embodiment, outsole 50 is made from more than one piece, each made from a different or similar material bonded/glued/welded together during or after the forming process. In such a case, outsole 50 may include different portions having different harnesses. For example, an anterior portion of outsole 50 is made from a first polymer having a first shore hardness welded to a posterior portion of outsole 50 made from a second material, having a second shore hardness, different from the first. For example, the first portion is harder than the second portion.

In an embodiment, the outsole or a portion of the outsole has a shore hardness of between 20 Sh-00 to 20 Sh-0. In an embodiment, the outsole or the portion of the outsole has a shore hardness of between 20 Sh-0 to 20 Sh-A. In an embodiment, the outsole or the portion of the outsole has Shore hardness of between 20 Sh-A to 20 Sh-B. In an embodiment, the outsole or the portion of the outsole has a shore hardness of between 20 Sh-B to 20 Sh-C. In an embodiment, the outsole or the portion of the outsole has a shore hardness of between 20 Sh-C to 20 Sh-D. In an embodiment, the outsole or the portion of the outsole has a shore hardness of between 20 Sh-C to 30 Sh-D. In an embodiment, the outsole or the portion of the outsole has a shore hardness of between 20 Sh-C to 40 Sh-D. In an embodiment, the outsole or the portion of the outsole has a shore hardness of between 20 Sh-C to 50 Sh-D. In an embodiment, the outsole or the portion of the outsole has a shore hardness of between 20 Sh-C to 60 Sh-D.

In an embodiment, the outsole or the portion of the outsole has a shore hardness of between 40 to 55 Sh A. In another embodiment, the outsole or the portion of the outsole has a shore hardness of between 50 to 70 Sh A. In another embodiment, the outsole or the portion of the outsole has a shore hardness of between 65 to 90 Sh A. In another embodiment, the outsole or the portion of the outsole has a shore hardness of between 55 to 60 Sh A. In another embodiment, the outsole or the portion of the outsole has a shore hardness of between 65 to 70 Sh A.

In another embodiment, outsole 50 includes a layer 70, contacting at least a portion of at least one recess 60. In another embodiment, outsole 50 includes a layer 70, contacting at least a portion of the outer surface of at least one recess 60 Layer 70 may be adapted to be in contact with both outsole 50 and one or more protuberance 20 and/or 30. Layer 70 may be made from a harder material, for example, a polymer having shore hardness at least 5% harder than the shore hardness of outsole 50. Harder layer 70 may provide additional durability to lower surface 55 or ground engaging surface of outsole 50. Therefore, when a protuberance, such as, protuberance 20 and/or 30 is connected or fixed to at least one recess 60, the softer material of outsole 50 may not deform by forces exerted by protuberance 20 and/or 30, for example, when subject's weight is exerted on protuberance 20 and/or 30. In an embodiment, layer 70 may include a polymer or similar material characterized by a shore hardness of between 20 Sh-A to 90 Sh-D.

In an embodiment, the layer has a shore hardness of between 20 Sh-0 to 20 Sh-A. In an embodiment, the layer has a shore hardness of between 20 Sh-A to 20 Sh-B. In an embodiment, the layer has a shore hardness of between 20 Sh-B to 20 Sh-C. In an embodiment, the layer has a shore hardness of between 20 Sh-C to 20 Sh-D. In an embodiment, the layer has a shore hardness of between 20 Sh-C to 30 Sh-D. In an embodiment, the layer has a shore hardness of between 20 Sh-C to 40 Sh-D. In an embodiment, the layer has a shore hardness of between 20 Sh-C to 50 Sh-D. In an embodiment, the layer has a shore hardness of between 20 Sh-C to 60 Sh-D. In an embodiment, the layer has a shore hardness of between 20 Sh-C to 80 Sh-D.

In an embodiment, the layer has a shore hardness of between 40 to 55 Sh A. In another embodiment, the layer has a shore hardness of between 50 to 70 Sh A. In another embodiment, the layer has a shore hardness of between 65 to 90 Sh A. In another embodiment, the layer has a shore hardness of between 55 to 60 Sh A. In another embodiment, the layer has a shore hardness of between 65 to 70 Sh A. In another embodiment, the layer has a shore hardness of between 50 to 90 Sh A. In another embodiment, the layer has a shore hardness of between 40 to 80 Sh A.

In another embodiment, outsole 50 includes one recess 60, as illustrated in FIGS. 2A and 2B, or more than one recess, for example, two recesses, an anterior recess 62 and a posterior recess 64 illustrated in FIG. 2C. Recess 60, illustrated in FIG. 2B, may include an anterior portion 61 which is adapted to match a base of an anterior protuberance 20, and a posterior portion 63 which is adapted to match a base of a posterior protuberance 30. In some embodiments, anterior recess 62, illustrated in FIG. 2C, is adopted to match anterior protuberance 20 and posterior recess 64 is adopted to match posterior protuberance 30. As should be understood by one skilled in the art, the specific shapes of recess 60, anterior recess 62, posterior recess 64, anterior protuberance 20, and posterior protuberance 30 are given as an example only, and the invention as a whole is not limited to these specific designs.

In another embodiment, outsole 50 may include one or more connectors 58 for connecting the one or more protuberances. Connectors 58 may be located at one or more places in recess 60, anterior recess 62, and/or posterior recess 64. For example, connectors 58 may be press stud (e.g., a snap), as illustrated, or any element that may allow detachable/removable attachment of the one or more protuberances to and from the at least one recess. Protuberances 20 and 30 assembled and removably attached to outsole 50 are illustrated in FIGS. 3A and 3B.

Geometrical Characterizations of the Outsole

Figure 3B:
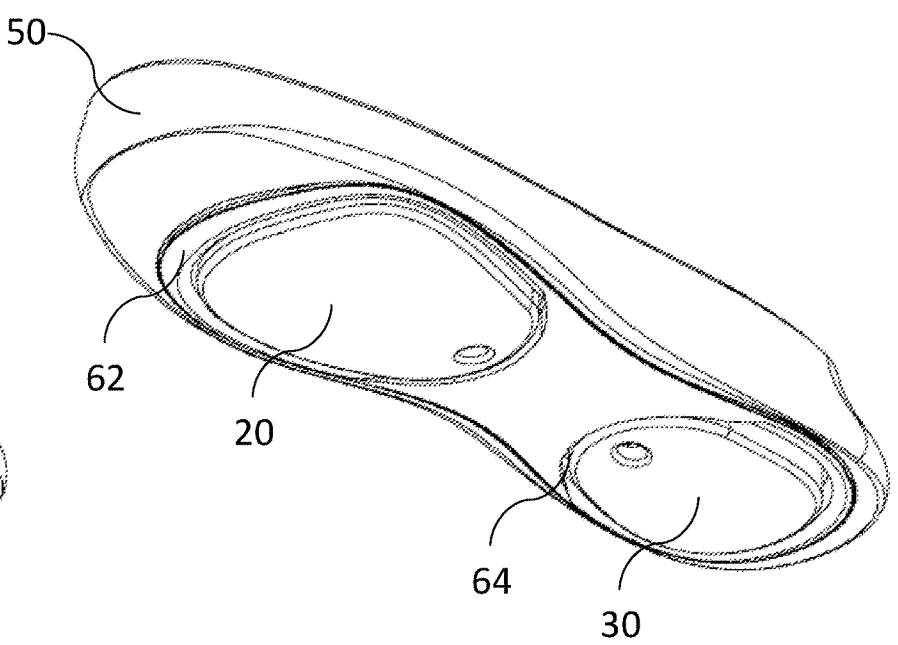
FIGS. 3A and 3B are bottom-view illustrations of perturbances assembled in outsoles according to some embodiments of the invention.
Figure 3A:
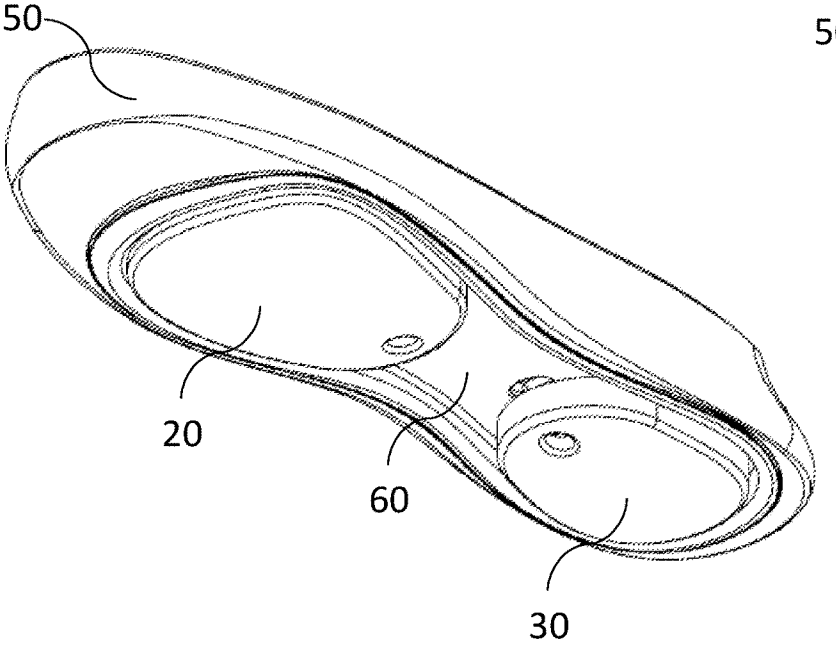

In another embodiment, a perimeter of at least one recesses 60, 62 and/or 64 delineates a base of one or more perturbances 20 and 30 adapted to fit and/or enclosed within, as illustrated in FIGS. 3A and 3B. The perimeter of each recess may loosely or tightly delineate the base of the one or more perturbances. For example, a gap of between 0.1 to 2 mm may be formed between the walls of the at least one recess and the base of the one or more perturbances. In yet another example, at least 25% of a base 24 and/or 34 (illustrated in FIG. 5B) of one or more protuberances 20 and/or 30 are delineated by the at least one recess 60, 62, and/or 64. In another embodiment, at least 30% of the base is delineated by the at least one recess. In another embodiment, at least 40% of the base is delineated by the at least one recess. In another embodiment, at least 50% of the base is delineated by the at least one recess. In another embodiment, at least 60% of the base is delineated by the at least one recess. In another embodiment, at least 70% of the base is delineated by the at least one recess. In another embodiment, at least 80% of the base is delineated by the at least one recess. In another embodiment, at least 90% of the base is delineated by the at least one recess.

In another embodiment, a protuberance's base occupies at least 50% of an area of a single recess 60 such that a first perimeter of the base is adapted to fit a second perimeter of single recess 60. For example, a gap of between 0.1 to 1 mm may be formed between the walls of recess 60 and the base of the single protuberance. In another embodiment, a protuberance's base occupies at least 60% of an area of a single recess 60. In another embodiment, a protuberance's base occupies at least 70% of an area of a single recess 60. In another embodiment, a protuberance's base occupies at least 80% of an area of a single recess 60. In another embodiment, a protuberance's base occupies at least 90% of an area of a single recess 60. In another embodiment, a protuberance's base occupies at least 95% of an area of a single recess 60.

In another embodiment, at least one recess 60, 62 and/or 64 has an area that covers between 10% to 95% of the entire ground engaging or outer surface 55 of outsole 50, as illustrated in FIGS. 2A-2C. The area of at least one recess 60, 62, and/or 64 may be measured at the bottom of each recess. Alternatively, the area of at least one recess 60, 62, and/or 64 may be measured as the area of the opening of at least one recess 60, 62, and/or 64 at ground engaging or outer surface 55. In another embodiment, the at least one recess has an area that covers between 15% to 85% of the entire ground engaging or outer surface. In another embodiment, the at least one recess has an area that covers between 20% to 80% of the entire ground engaging or outer surface. In another embodiment, the at least one recess has an area that covers between 30% to 95% of the entire ground engaging or outer surface. In another embodiment, the at least one recess has an area that covers between 40% to 95% of the entire ground engaging or outer surface. In another embodiment, the at least one recess has an area that covers between 50% to 95% of the entire ground engaging or outer surface.

In another embodiment, bases 24 and 34 of two protuberances 20 and 30 may occupy at least 40% of an area of single recess 60, as illustrated in FIG. 3A. In another embodiment, the bases of two or more protuberances may occupy at least 50% of an area of the single recess. In another embodiment, the bases of two or more protuberances occupy at least 60% of an area of the single recess. In another embodiment, the bases of two or more protuberances may occupy at least 70% of an area of the single recess. In another embodiment, the bases of two or more protuberances may occupy at least 80% of an area of the single recess. In another embodiment, the bases of two or more protuberances may occupy at least 90% of an area of the single recess. In another embodiment, the bases of two or more protuberances may occupy at least 95% of an area of the single recess.

Figure 4B:
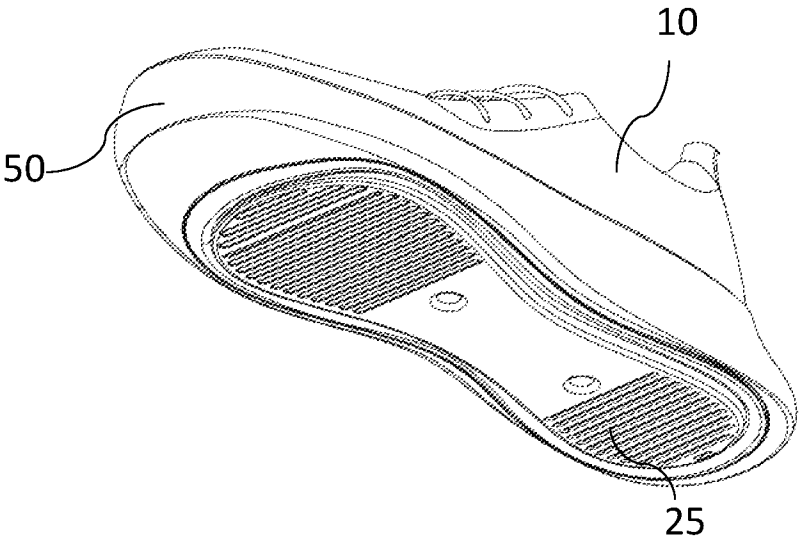
FIGS. 4A and 4B are bottom-view illustrations, respectively, of a kit and an assembled footwear including a single perturbance.
Figure 4A:
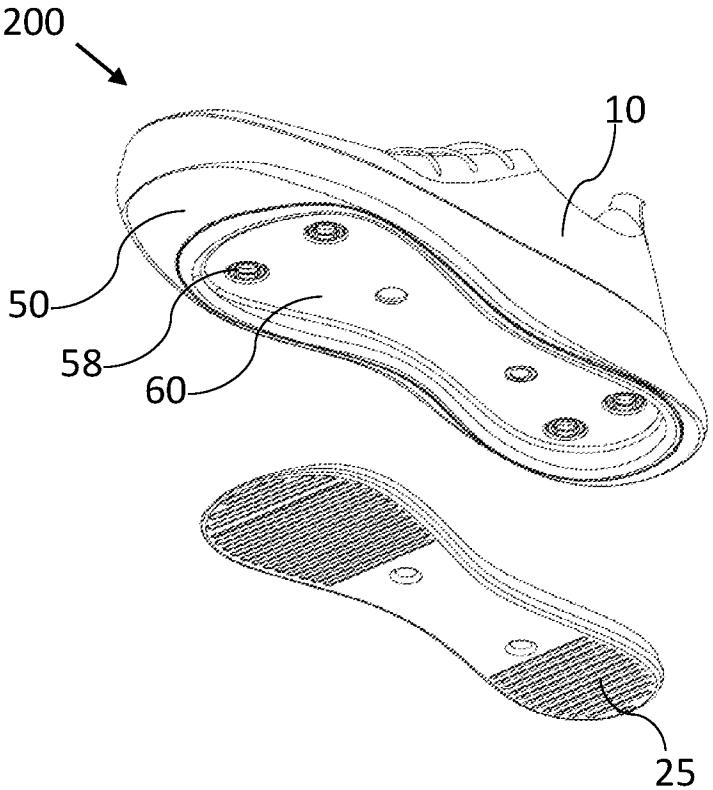

Reference is now made to FIGS. 4A and 4B which are bottom-view illustrations, respectively, of a kit and an assembled footwear including a single perturbance according to some embodiments of the invention. In another embodiment, recess 60 of outsole 50 is configured to accommodate a single perturbance 25. In another embodiment, a protuberance 25 base occupies at least 80% of an area of a single recess 60 such that a first perimeter of the base is adapted to fit a second perimeter of single recess 60. In another embodiment, a protuberance 25 base occupies at least 90% of an area of a single recess 60. In another embodiment, a protuberance 25 base occupies at least 95% of an area of a single recess 60. In one embodiment, protuberance 25 is a substantially flat protuberance. Alternatively, protuberance 25 is a non-flat protuberance, as discussed hereinbelow.

In another embodiment, two or more recess 62 and 64 of outsole 50 is configured to accommodate two or more substantially flat protuberance perturbances 25.

Figure 5A:
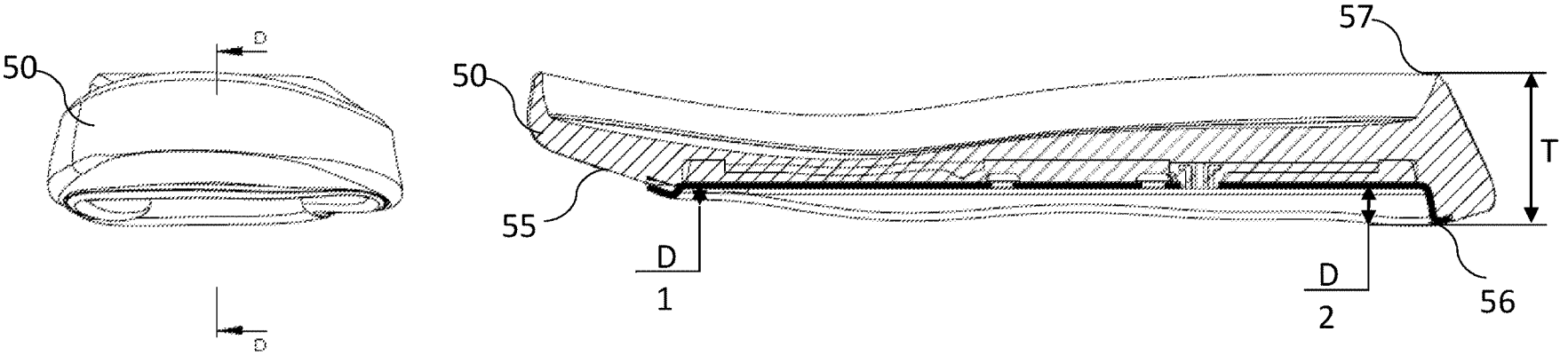
FIGS. 5A and 5B are, respectively, front view and cut in an outsole and an outsole accommodating perturbances according to some embodiments of the invention.
Figure 5B:
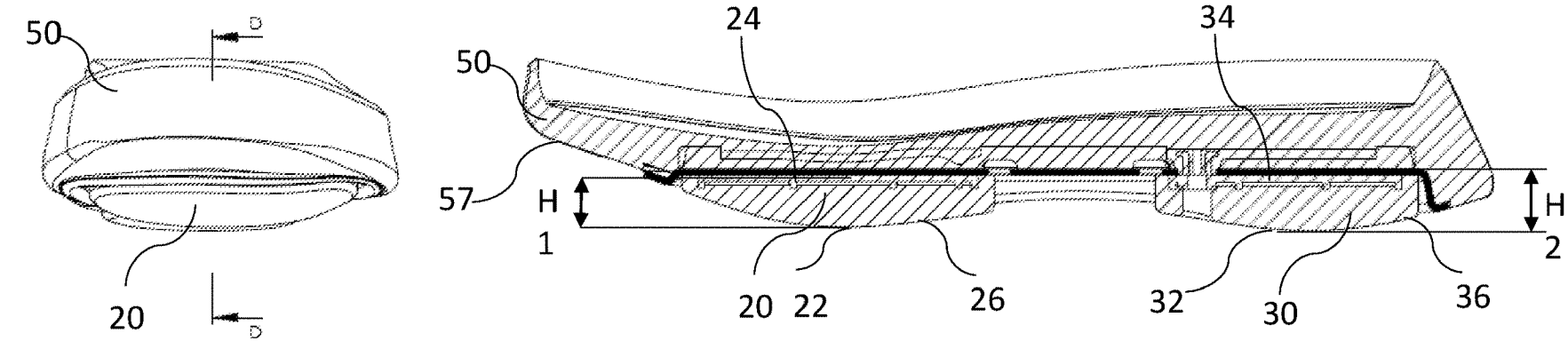

Reference is now made to FIGS. 5A and 5B which are illustrations of front view and cut in outsole 50 and an outsole accommodating perturbances according to some embodiments of the invention.

In another embodiment, at least one recesses 60, 62, and/or 64 may have a depth D1 and/or D2 of between 10% to 95% of the maximum thickness T of outsole 50. The depth may vary across the recess, for example, depth D1 of anterior portion 61 or anterior recess 62 is smaller than depth D2 of posterior portion 63 or posterior recess 64, as illustrated. The maximum thickness T of outsole 50 may be measured from a ground engaging point 56 at ground engaging surface 55 to the upper point 57 at a surface of outsole 50 that is adopted to be attached to an insole. In another embodiment, the at least one recesses may have a depth D1 and/or D2 of between 15% to 95% of the maximum thickness T of the outsole. In another embodiment, the at least one recesses may have a depth D1 and/or D2 of between 20% to 90% of the maximum thickness T of the outsole. In another embodiment, the at least one recesses may have a depth D1 and/or D2 of between 10% to 90% of the maximum thickness T of the outsole. In another embodiment, the at least one recesses may have a depth D1 and/or D2 of between 10% to 80% of the maximum thickness T of the outsole. In another embodiment, the at least one recesses may have a depth D1 and/or D2 of between 10% to 70% of the maximum thickness T of the outsole. In another embodiment, the at least one recesses may have a depth D1 and/or D2 of between 10% to 60% of the maximum thickness T of the outsole.

In another embodiment, a recess is configured to securely fasten a protuberance. In another embodiment, a single recess is configured to securely fasten a protuberance. In another embodiment, a single recess is configured to securely fasten two protuberances. In another embodiment, two separate recesses are each separately configured to securely fasten a protuberance or a single protuberance. In another embodiment, a recess comprises a protuberance securing means and/or fixing means. In another embodiment, a protuberance comprises a recess securing means and/or fixing means.

Protuberances

In another embodiment, a protuberance has a base portion and a peak portion. In another embodiment, the base portion is the bottom part of the protuberance, and the peak is the upper part of the protuberance. In another embodiment, the peak or the upper part portion occupies 5 to 60% of the protuberance volume. In another embodiment, the peak or the upper part portion occupies 10 to 40% of the protuberance volume. In another embodiment, the peak or the upper part portion occupies 5 to 30% of the protuberance volume. In another embodiment, the base or the bottom part portion occupies 30 to 95% of the protuberance volume. In another embodiment, the base or the bottom part portion occupies 40 to 95% of the protuberance volume. In another embodiment, the base or the bottom part portion occupies 60 to 90% of the protuberance volume. In another embodiment, the base or the bottom part portion occupies 70 to 95% of the protuberance volume.

In another embodiment, a protuberance has a harder lower portion (connectable to the recess) and a softer upper portion which includes the peak portion. In some embodiments, the harder lower portion is at least 10% harder than the softer lower portion. In some embodiments, the harder lower portion is at least 20% harder than the softer lower portion. In some embodiments, the harder lower portion is at least 30% harder than the softer lower portion. In some embodiments, the harder lower portion is at least 40% harder than the softer lower portion. In some embodiments, the harder lower portion is at least 50% harder than the softer lower portion.

In another embodiment, the upper softer portion occupies 30 to 90% of the protuberance volume. In another embodiment, the upper softer portion occupies 40 to 90% of the protuberance volume. In another embodiment, the upper softer portion occupies 30 to 80% of the protuberance volume. In another embodiment, the upper softer portion occupies 50 to 90% of the protuberance volume. In another embodiment, the upper softer portion occupies 40 to 70% of the protuberance volume. In another embodiment, the upper softer portion occupies 60 to 90% of the protuberance volume.

In another embodiment, the lower harder portion occupies 10 to 70% of the protuberance volume. In another embodiment, the lower harder portion occupies 20 to 60% of the protuberance volume. In another embodiment, the lower harder portion occupies 10 to 60% of the protuberance volume. In another embodiment, the lower harder portion occupies 20 to 70% of the protuberance volume. In another embodiment, the lower harder portion occupies 10 to 50% of the protuberance volume. In another embodiment, the lower harder portion occupies 10 to 50% of the protuberance volume. In another embodiment, the lower harder portion occupies 10 to 40% of the protuberance volume. In another embodiment, the lower harder portion occupies 30 to 70% of the protuberance volume.

In another embodiment, assembled footwear 100 or kit 200 includes one or more (e.g., two) protuberances, such as, protuberances 20 and 30. In another embodiment, at least one protuberance 20 and/or 30 includes a ground engaging peak 22 and/or peak 32 and a base 24 and/or base 34, respectively, as illustrated in FIG. 5B. In another embodiment, a protuberance at its peak 22 and/or peak 32 is at least 10% higher than a maximum depth of at least one recess 60, 62 and/or 64. For example, the height H2 of the protuberance at peak 32 may be at least 10% higher than depth D2 of recess 60. The height H1 or H2 is measured, for example, from based 34 to peak 32. In another embodiment, the protuberance at its peak is at least 15% higher than a maximum depth of the at least one recess. In another embodiment, the protuberance at its peak is at least 20% higher than a maximum depth of the at least one recess. In another embodiment, the protuberance at its peak is at least 30% higher than a maximum depth of the at least one recess. In another embodiment, the protuberance at its peak is at least 40% higher than a maximum depth of the at least one recess. In another embodiment, the protuberance at its peak is at least 50% higher than a maximum depth of the at least one recess. In another embodiment, the protuberance at its peak is at least 60% higher than a maximum depth of the at least one recess. In another embodiment, the protuberance at its peak is at least 70% higher than a maximum depth of the at least one recess. In another embodiment, the protuberance at its peak is at least 80% higher than a maximum depth of the at least one recess. In another embodiment, the protuberance at its peak is at least 95% higher than a maximum depth of the at least one recess. In another embodiment, the protuberance at its peak is at least twice as higher than a maximum depth of the at least one recess.

In another embodiment, a ground engaging surface (e.g., the surfaces of peak 22 and peak 32) of one or more protuberances 20 and 30 extends outwards from the outsole or extends outwards at least one recess 60, 62, and/or 64 when the one or more protuberances 20 and 30 are placed and/or fixed in at least one recess 60, 62 and/or 64, as shown in FIGS. 3A, 3B, and 4B.

Referring back to FIGS. 4A and 4B which show a single substantially flat protuberance 25. In one embodiment, the additional protuberance is substantially flat protuberance 25. In one embodiment, a kit includes a set of two substantially flat protuberances to be assembled in at least one recess 60 or in two different recess 62 and 64. One or more substantially flat protuberances include a flat ground-engaging surface. Such a flat ground engaging surface may be patterned to allow better ground-surface engagement. In another embodiment, one or more protuberances are constructed with one or more flexible areas to improve ground surface engagement and to ease the use of the footwear. In another embodiment, a kit includes a pair of curved or bulbous protuberances and a pair of flat protuberances.

In another embodiment, the maximum thickness of at least one substantially flat protuberance is the same or higher than the maximum depth of the at least one recess. In another embodiment, the maximum thickness of at least one substantially flat protuberance 25 is at least 5% higher than the maximum depth of the at least one recess. In another embodiment, the maximum thickness of at least one substantially flat protuberance 25 is at least 10% higher than the maximum depth of the at least one recess. In another embodiment, the maximum thickness of at least one substantially flat protuberance 25 is at least 15% higher than the maximum depth of the at least one recess. In another embodiment, the maximum thickness of at least one substantially flat protuberance 25 is at least 20% higher than the maximum depth of the at least one recess. In another embodiment, the maximum thickness of at least one substantially flat protuberance 25 is at least 30% higher than the maximum depth of the at least one recess. In another embodiment, the maximum thickness of at least one substantially flat protuberance 25 is at least 40% higher than a maximum depth of the at least one recess.

In another embodiment, in the assembled footwear a portion of a protuberance occupies at least 80% of the recess area or volume. In another embodiment, in the assembled footwear a portion of a protuberance occupies at least 85% of the recess area or volume. In another embodiment, in the assembled footwear a portion of a protuberance occupies at least 90% of the recess area or volume. In another embodiment, in the assembled footwear a portion of a protuberance occupies at least 95% of the recess area or volume. In another embodiment, in the assembled footwear a portion of a protuberance occupies at least 97% of the recess area or volume.

In another embodiment, in the assembled footwear a bottom portion or the base portion a protuberance comprises an outer surface, wherein the outer-surface contacts the recess occupies at least 95% of the recess area or volume. In another embodiment, an outer surface contacts layer 70.

In another embodiment, in the assembled footwear, a bottom portion or the base portion of a protuberance occupies at least 95% of the recess area or volume. In another embodiment, in the assembled footwear, 2-50%, 2-20%, 5-40%, 20-40%, 5-15%, or 10-30% of the protuberance volume occupies at least 80%, 85%, 90%, 95% or 97% of the recess area or volume.

In another embodiment, at least one of protuberance 20 and/or 30 is a bulbous protuberance. In another embodiment, the protuberance is symmetrical. In another embodiment, a protuberance is asymmetrical In another embodiment, a protuberance comprises a shape of a: polygon, decagon, digon, dodecagon, nonagon, henagon hendecagon, heptagon, hexadecagon, hexagon icosagon, octagon, pentagon, triangle, Penrose tile, trapezium, isosceles, trapezium undecagon, quadrilateral, Lozenge, rhomboid, rectangle, square, rhombus, trapezoid, polydrafter, arbelos, circle, disc, circle, excircle, crescent, dome, ellipse, lune, oval, sphere, asteroid, or deltoid. In another embodiment, at least one of protuberance 20 and/or 30 has an amorphic curvature.

In another embodiment, each protuberance 20 or 30 has a curved outer contour 26 or 36. In another embodiment, each protuberance 20 or 30 has a different curved outer contour, as illustrated. In another embodiment, each protuberance 20 or 30 has a convexity.

In another embodiment, outer contours 26 and/or 36 of one or more protuberances 20 and/or 30 and an outer contour 57 of outsole 50 form a continuous curvature, as illustrated in FIG. 5B. In another embodiment, the curvature is continuous across any cross-section of the outsole and the one or more protuberances, or at one or more specific cross-sections. For example, the curvature may be continuous across the longitudinal cross-section (as illustrated) and/or across the lateral cross-section.

In another embodiment, a protuberance, such as, protuberance 20 and/or 30, comprises a dome shape. In another embodiment, a protuberance as described herein comprises a dome shape which further comprises multiple different convexities. In another embodiment, each protuberance 20 or 30 comprises a different convexity. In another embodiment, each protuberance 20 or 30 comprises a different set of convexities. Each possibility represents a separate embodiment of the present invention.

In another embodiment, the contours 26 and/or 36 may have the shape of a conic section, that is, the shape of a circle, ellipse, parabola or hyperbola. The various cross-sections of the contours 26 or 36 of protuberance 20 or 30 may be shaped identically or differently. In another embodiment, the shape of a protuberance is defined by equal arches. In another embodiment, the shape of a protuberance is defined by a variety of arches of different radiuses which are tangent to each other. In another embodiment, the shape of a protuberance is symmetrical. In another embodiment, the shape of a protuberance is asymmetrical. In another embodiment, a protuberance is a bulbous protuberance. Each possibility represents a separate embodiment of the present invention.

In another embodiment, the invention provides that the assembled footwear such as assembled footwear 100 supports the foot of a subject only by the one or more protuberances when the one or more protuberances are placed on a ground surface. In another embodiment, the invention provides that the device such as assembled footwear 100 supports the foot of a subject during stance only by the two protuberances 20 and 30 when the two protuberances are placed on a ground surface. In another embodiment, the invention provides that during stance only the 2 ground engaging surfaces of the protuberances (such as the peak or the surface facing the ground) are in contact with a ground surface. In another embodiment, the invention provides that during stance only the ground engaging surface in each protuberance is in contact with a ground surface. Each possibility represents a separate embodiment of the present invention.

In another embodiment, the ground engaging parts of the assembled footwear 100 are only the protuberances. In another embodiment, during all phases of gait including the stance phase the protuberances are the only parts of the assembled footwear which are ground engaging. In another embodiment, during all phases of gait including the stance phase the protuberances 20 and 30 are the only parts of the assembled footwear which are in direct contact with the ground. Each possibility represents a separate embodiment of the present invention.

In another embodiment, the ground engaging parts of the assembled footwear comprise protuberances 20, 25 and 30. In another embodiment, the ground engaging parts of the assembled footwear comprise ground engaging surface 55 of outsole 50. In another embodiment, during all phases of gait including the stance phase the protuberances are the only parts of the footwear kit which are ground engaging.

In another embodiment, a protuberance as described herein is mountable to a recess in the outsole. In another embodiment, a protuberance as described herein is fixedly mounted to a recess in the outsole. In another embodiment, a protuberance as described herein is replaceable.

In another embodiment, a protuberance is relatively stiff and is not compressible under the weight of the subject (20-150 kg) wearing the footwear, therefore has a shore hardness of between 30 to 90 Sh A. In another embodiment, a protuberance has a shore hardness of between 40 to 55 Sh A. In another embodiment, a protuberance has a shore hardness of between 50 to 70 Sh A. In another embodiment, a protuberance has a shore hardness of between 65 to 90 Sh A. In another embodiment, a protuberance has a shore hardness of between 55 to 60 Sh A. In another embodiment, a protuberance has a shore hardness of between 65 to 70 Sh A. In another embodiment, an anterior and a posterior protuberance comprise identical shore hardness. In another embodiment, an anterior and a posterior protuberance comprise different shore hardness. Each possibility represents a separate embodiment of the present invention.

In another embodiment, a protuberance is relatively stiff and is not compressible therefore maintain its contour under the weight of the subject (20-150 kg). In another embodiment, non-compressible protuberance maintains its contour under the weight of 0-150 kg. In another embodiment, non-compressible protuberance maintains its contour, convexity, height, or any combination thereof under the weight 0-150 kg.

In another embodiment, a protuberance is a soft protuberance comprising a shore hardness of between 40 to 55 Sh A. In another embodiment, a protuberance is a medium hardness protuberance comprising a shore hardness of between 50 to 70 Sh A. In another embodiment, a protuberance is a hard protuberance comprising a shore hardness of between 65 to 90 Sh A.

In another embodiment, a protuberance has an abrasion between 1-60 $mm^3$ (by DIN 53516). In another embodiment, a protuberance comprises a rubber cup. In another embodiment, a protuberance comprises natural rubber compounds. In another embodiment, a protuberance comprises synthetic rubber compounds such as TPU or TPR. In another embodiment, a protuberance comprises casted polyurethan. In another embodiment, a protuberance comprises Ethylene-vinyl acetate. In another embodiment, a protuberance comprises silicone. In another embodiment, a protuberance a plastic material such as PA 6 (nylon), PA6/6 (nylon)+glass fiber, ABS, Polypropylene, POM (Polyoxymethylene). In another embodiment, a protuberance comprises a metal such as aluminum, steel, stainless steel, brass, or metal alloys. In another embodiment, a protuberance comprises compound materials such as glass fibers, carbon fibers, kevlar, or any combination thereof. Each possibility represents a separate embodiment of the present invention.

In another embodiment, the geometric shape and/or the construction of protuberances 20, 30 and/or 25 are adopted to react upon the application of pressure. When the subject is standing, walking and/or running the shape and/or construction of protuberances 20, 30 and/or 25 changes. In such case, the location of the peak in protuberances 20 and 30 changes with the position of the foot.

Therefore, protuberances 20, 30 and/or 25 include one or more deformable materials. A deformable material is defined as a material that allow deformation of at least 10% of its original shape due to the application of an external pressure, during service (e.g., at room temperature). For example, a protuberance may include a flexible shell filled with liquids (e.g., water, oil), granular material (e.g., sand), gels and the like.

Selecting a Protuberance

In one embodiment, kit 200 is supplied with at least one set of one or more protuberances. Upon receiving a selected set, the subject may easily connect the one or more protuberances 20, 30, and/or 25 to the outsole, for example, using connectors 58, to form assembled footwear 100, and wear the assembled footwear 100.

In another embodiment, each set provided with the kit, may be selected to manipulate at least one gait parameter and/or to treat a pathology. Additionally or alternatively, at least one set of protuberances includes one or more substantially flat protuberances. In some embodiments, a kit 200 may include one set of one or more substantially flat protuberances and at least one other set that includes of one or more non-flat functional protuberances. In some embodiments, the gait parameters are selected from: foot alignment, knee alignment, velocity, swing and stance phase, double support time, ground reaction forces, impulse, propulsion during habitual walking, kneed alignment, center of pressure, symmetry, gait speed, step time, step length, stride length, step width, foot angle, demarcation between walking and running and the like.

As should be understood by one skilled in the art, the non-flat protuberances are functional protuberances, selected according to the disclosed hereinbelow.

In another embodiment, the set may be selected to include a protuberance having a convexity, a height, a structure and/or peak adapted to manipulate at least one gait parameter, treat or reduce lower limb or back pain or ameliorate a lower limb pathology or a pelvic disorder such as but not limited to urinary incontinence. In some embodiment, the peak's location, surface area, and/or convexity is/are adapted to manipulate at least one gait parameter, treat, or reduce lower limb or back pain or ameliorate a lower limb pathology or a pelvic disorder such as but not limited to urinary incontinence. In some embodiment, the peak's location is its location along the outsole. In some embodiment, the peak's location is its location in relation to the center of the protuberance's base or the outer surface of the base.

In some embodiments, the one or more protuberances in the set may be selected according to the required manipulation of the at least one gait parameter or the ameliorate a lower limb pathology. In another embodiment, the height (e.g., height H) of the protuberance at its peak is adapted to manipulate the at least one gait parameter, treat, or reduce lower limb or back pain or ameliorate a lower limb pathology or a pelvic disorder such as but not limited to urinary incontinence.

In some embodiments, sets of protuberances may be manufactured for a combination of subjects and pathologies, such that, a person may select footwear 100 and/or kit 200 based on at least two characterizations. For example, a person may order footwear 100 of kit 200 based on his/her age, gender, gait parameter/s and pathology/medical condition. A list of pathologies and medical conditions that can be treated by footwear 100 or kit 200 is listed hereinbelow.

In another embodiment, kit 200 or assembled footwear 100 is supplied with two or more sets of protuberances. In one embodiment, each protuberance in kit 200 or assembled footwear is different with respect to at least the location of the peak, the height of the protuberance at its peak, the convexity, shore-hardness, or any combination thereof. In one embodiment, a first set of protuberances may be selected to manipulate a first gait parameter and a second set of protuberances is selected to manipulate a second gait parameter. In one embodiment, a first set of protuberances is selected for initial treatment of a pathology or pain and a second set is selected for further treatment of a pathology or pain.

In another embodiment, a set comprises two protuberances for each shoe of footwear 100. In another embodiment, a set comprises four protuberances for both shoes (2 shoes) of footwear 100. In another embodiment, each protuberance or set is specifically designed to a subject or a gait condition. In another embodiment, each set is designed and manufactured for a group of subjects having a similar pathology or similar gait parameters. In another embodiment, each set is designed and manufactured for a group of subjects having at least one similar gait parameter. Each possibility represents a separate embodiment of the present invention.

In another embodiment, the selection of a protuberance and/or the sets of perturbances 20 and 30 is for treatment and alleviating pain for the following diseases and/or conditions: Medial Compartment knee OA, medial meniscus—tear/damage, Genu varus, Patello—femoral pain syndrome, Patello—femoral problem (malalignment), Lateral collateral ligamental (damage/tear), Bone bruise MTP/MFC (AVN), hip OA, Hip labrum damage (TCM), Trochanteric bursitis, Pes Anseninus bursitis, Ankle instability (supination+ext rut), Achilles tendonitis, Metatrsalgia, or a combination thereof.

In another embodiment, the selection of a protuberance and/or the sets of perturbances is for treatment and alleviating pain for the following diseases and/or conditions: a spinal disorder, a spinal pathology, a spinal injury, and/or a spinal related pathology. In another embodiment, the selection of the sets of perturbances is for treatment and alleviating pain for subject suffering from a neurological condition.

Design of Protuberances

In another embodiment, protuberances are designed and fabricated, for example, using three-dimensional (3D) printing or any other CAD-CAM fabrication method, for treating different conditions. Each perturbance has parameters selected from, the location of the peak, the height of the protuberance at its peak, the convexity, shore-hardness, or any combination thereof.

In some embodiments, for each protuberance at least a location of a peak is determined based on at least one gait parameter and/or balance parameters of the subject measured for a group of subjects. In some embodiments, measurements of a selection of gait parameters may be taken from a plurality of subjects such as a group, all having at least two common characteristics, selected from, age, gender, height, weight, foot size, gait behavior, pathology and the like. In some embodiments, subjects having the common gait behavior are subjects having at least two similar gait parameters. In some embodiments, a group of subjects is defined as subjects having a deficiency in 1, 2, 3, 4, 5, 5, 6, 7, 8, 9, 10 or any range therebetween, common gait parameter/s (common gait deficiencies or deficiency). In some embodiments, common gait behavior is defined a common deficiency in 1, 2, 3, 4, 5, 5, 6, 7, 8, 9, 10 or any range therebetween, common gait parameter/s.

As used herein the balance parameters of the subject includes parameters associated with the standing/balance position and posture of the subject. The balanced position being a position whereby the device provides a reduced and/or minimum inversion or a reduced and/or minimum eversion to the subject's foot during the stance phases. In some embodiments, the balanced position is toning the amount of tension or resistance to movement in a muscle involved in gait. The balanced position is providing a reduction of muscle tone, larger passive ankle excursion, improved gait ability, or any combination thereof.

The balance parameters are parameters in which the footwear exerts the least valgus, varus, dorsal or plantar torque about the ankle in a subject being examined. Parameters such as, the weight distribution between the legs, leaning of the subject's body, the structure of the spinal cord while standing and the like.

In some embodiments, the subjects are grouped according to age groups (e.g., 20-30 years, 30-45 years, 45-50 years, 50-55 years, 55-60 years, and the like) and gender. In some embodiments, the subjects are grouped according to age groups and pathology, for example, subjects aged 50-55 years having a lower limb pathology. In yet another example, the group of subjects may include women aged 60-70 having a pelvic disorder such as but not limited to urinary incontinence. In some embodiments, the subjects are grouped according to age, common gait behavior/common gait deficiencies or deficiency, a pathology (such as but not limited to a lower limb pathology, spine pathology, and urinary incontinence), or any combination thereof.

In some embodiments, the subjects are grouped according to age groups and gait behavior/common deficiencies or deficiency. For example, subject not diagnosed with any specific limb or back pathology, are grouped according to subjects of the same age group having substantially the same (e.g., less than 10% difference) at least two gait parameters, for example, substantially the same, foot alignment, knee alignment, gait speed, step time, step length, stride length, step width, foot angle, demarcation between walking and running, velocity, swing and stance phase, double support time, ground reaction forces, impulse, propulsion during habitual walking, and the like.

In some embodiments, gait parameter measurements taken from each group of subjects are used to design a set of protuberances suitable for a group as provided herein (any subject having similar characteristics). In some embodiments, the subject or a professional can select the set of protuberances based on the group characteristics that fit a characteristic of the subject such as gait behavior/common gait deficiencies or deficiency, a pathology (such as but not limited to a lower limb pathology, spine pathology, and urinary incontinence), or any combination thereof.

In some embodiments, additionally or alternatively to the peak location, the curvature of each protuberance and/or the contour of a base of the protuberance may be determined based on the at least one gait parameter and/or the balance parameters of the subject measured for the group of subjects.

In some embodiments, the gait parameter/s and/or the balance parameters measurements from each group of subjects are used to select a plurality of geometrical parameters that effect, the locations of the peaks, the curvature of each protuberance and the couture of each protuberance. In some embodiments, the parameters are selected from, the location of the peaks with respect to the topography and contour of the outsole (e.g., interior and exterior protuberances), the height of the peak, the convexity(ies) of the curvature at each direction and the like.

Reference is now made to FIGS. 6A, 6B, 6C and 6D which are, respectively, bottom view, front view, side view, and back view of an outsole accommodating perturbances designed based on gait parameters, according to some embodiments of the invention. In some embodiments, for each of protuberances 20 or 30 at least a location of the corresponding peak 22 or 32 is determined based on at least one gait parameter and/or the balance parameters of the subject measured for a group of subjects. For example, the area of each protuberance 20 or 30 may be divided by grids 40 and 45 comprising a lateral median line and a longitudinal median line. For example, the area of protuberance 20 may be divided by grid 40 and may include a lateral median line 41 and a longitudinal median line 42. Similarly, the area of protuberance 30 may be divided by grid 45 and may include a lateral median line 43 and a longitudinal median line 44.

In the nonlimiting example illustrated in FIGS. 6A, 6B, 6C, and 6D, the location of peaks 22 and 32 were determined based on gait parameters received from a group of women aged 35-45 having urinary incontinence. After receiving the measurements, a controller may decide, for example, based on previously collected data, where is the optimal location of peaks 22 and 32, in order to treat urinary incontinence for this group. In this nonlimiting example peak 22 is 0.5 step to the left from longitudinal median line 42 on lateral median line 41, and peak 32 is 0.5 step to the right from longitudinal median line 44 on lateral median line 43.

In some embodiments, the contours of protuberances 20 or 30 may also be determined based on gait parameters measured from a group of subjects. In the nonlimiting example, of FIG. 6A contour 46 of protuberance 20 and contour 47 of protuberance 30 were determined based on gait parameters received from a group of women aged 35-45 having urinary incontinence and designed to treat these specific groups.

Figure 6A:
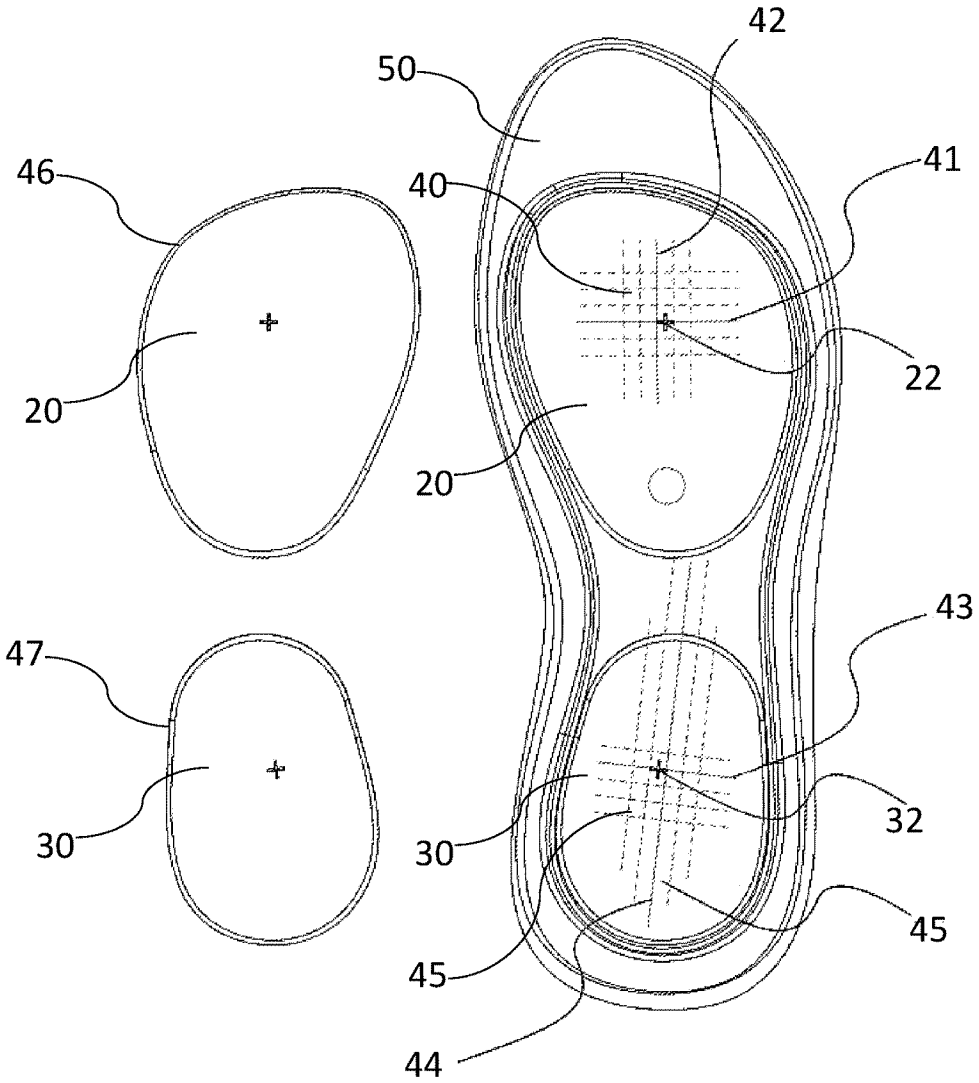
FIGS. 6A, 6B, 6C and 6D are, respectively, bottom view and side view of an outsole accommodating perturbances designed based on gait parameters, according to some embodiments of the invention.
Figure 6D:
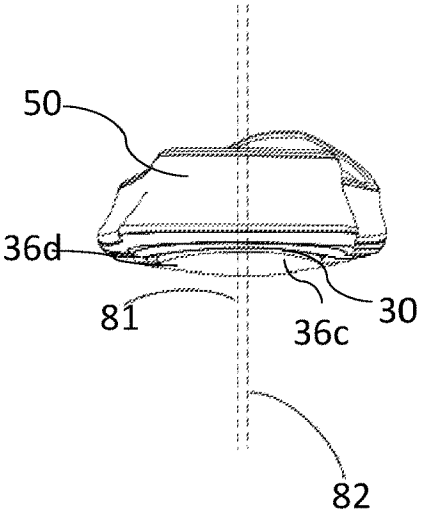
Figure 6C:
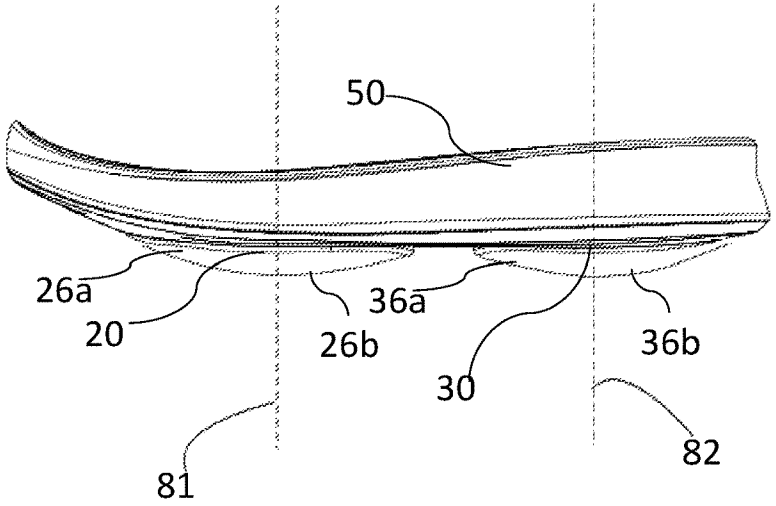
Figure 6B:
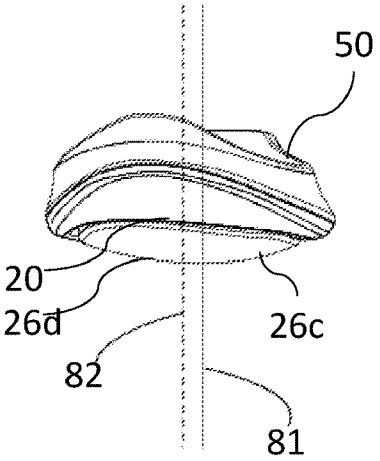

In some embodiments, the curvatures of protuberances 20 or 30 may also be determined based on gait parameters measured from a group of subjects. In some embodiments, each protuberance 20 or 30 may be divided by a corresponding vertical median line 81 and 82. The vertical median lines may divide curvatures 26 and 36 into different convexities. In the nonlimiting example of FIGS. 6B, 6C, and 6D, curvature 26 is divided into four different convexities 26*a*, 26*b*, 26*c* and 26*d*, and curvature 36 is divided into four different convexities 36*a*, 36*b*, 36*c*, and 36*d*. In some embodiments, each of the convexities may be determined based on gait parameters measured from a group of subjects. In the nonlimiting of FIGS. 6B, 6C, and 6D convexities 26*a*, 26*b*, 26*c* and 26*d* and convexities 36*a*, 36*b*, 36*c* and 36*d* were determined based on gait parameters received from a group of women aged 35-45 having urinary incontinence and designed to treat this specific group.

In some embodiments, the hardness of each protuberance 20 or 30 may also be determined based on the on gait parameters received from a group of subjects. A similar methodology may be applied to the required hardness. For example, relatively stiff (e.g., non-compressible) materials may be selected, having shore hardness of between 30 to 90 Sh A. In specific examples, shore hardness of 60 ShA is selected to treat a pelvic disorder such as but not limited to urinary incontinence, in women aged 40-45, while shore hardness of 70 ShA is selected for protuberances aiming to prevent back aces in men aged 40 to 60.

In some embodiments, a training stage may be conducted in which gait parameter measurements from different groups of subjects may be collected and designs for the protuberances may be suggested based on known geometrical parameters of the protuberances. These geometrical parameters may have known effects on subjects and pathologies and may be received from professionals (e.g., doctors, physiotherapists, trainers, etc.) treating individuals within the group of subjects. In some embodiments, the geometrical parameters may include, the locations of the peaks, the height of the peaks, and various curvatures. For example, a controller may collect various peak locations for a specific group, and may determine what is the optimal location of the peaks using any mathematical model, e.g., the average location, the most common location, etc. After designing an initial design, the initial design is manufactured, and the design may be tested on subjects within the group to receive a feedback form the subjects and/or the professionals. If required improvements may be made in the design.

In another embodiment, the protuberances are designed and fabricated to treat a subject afflicted with patella-femoral pain and hyper-laxity. The parameters of an anterior protuberance and a posterior protuberance are selected to improve the balance of the subject and to reduce pain. In another embodiment, the protuberances are designed and fabricated to treat a subject afflicted with patella-femoral pain, an early heel rise, and hyper-laxity. The parameters of an anterior protuberance and a posterior protuberance are selected to improve the balance of the subject and to reduce pain. Additionally, the height of the posterior protuberance at its peak is selected to be higher than the height of the anterior protuberance at its peak, in order to reduce an early heel rise.

In another embodiment, the protuberances are designed and fabricated to treat a subject afflicted with patella-femoral knee OA, a relative higher ROM (range of motion) of knee compared to age matched, pain that is relieved upon walking up-hill, and a delayed heel rise. The parameters of an anterior protuberance and a posterior protuberance are selected to improve the balance of the subject and to reduce the pain. Additionally, the height of the posterior protuberance at its peak is selected to be lower than the height of the anterior protuberance at its peak, in order to adjust the subject's heel rise during stance.

In another embodiment, the protuberances are designed and fabricated to treat a subject afflicted with medial compartment knee OA, a sudden strong pain in the left knee, an A-vascular necrosis in the proximal medial tibia plateau of the left knee, a single limb support of 33% in the left leg, and a single limb support of 37.5% in the right leg. The parameters of an anterior protuberance and a posterior protuberance are selected to improve the balance of the subject and to reduce pain. Additionally, the height of the anterior protuberance and the posterior protuberance of the left leg, at their peaks, are selected to be higher than the height of the protuberance, of the right leg.

In another embodiment, the protuberances are designed and fabricated to treat a subject afflicted with knee pain during heel-strike. In such case, the location of the peak of the posterior protuberance is selected posterior protuberance laterally to the centerline. In another embodiment, protuberances are designed and fabricated to treat a subject afflicted with knee pain during mid-stance/toe-off. In such case, the location of the peak of the anterior protuberance is selected to be lateral to the centerline of the assembled footwear.

In another embodiment, the centerline of the assembled footwear divides longitudinally the calcaneus support portion into two equal halves and further extends towards the phalanges and metatarsals support portion in a straight line. In another embodiment, the centerline of the assembled footwear divides longitudinally the arch of the calcaneus support portion into two equal halves and further extends towards the phalanges and metatarsals support portion in a straight line. In another embodiment, the centerline of the assembled footwear divides longitudinally the proximal arch of the calcaneus support portion into two equal halves and further extends towards the phalanges and metatarsals support portion in a straight line. In another embodiment, the centerline divides of the assembled footwear longitudinally the calcaneus support portion into two equal halves and further extends towards the phalanges and metatarsals support portion in a straight line. Each possibility represents a separate embodiment of the present invention.

In another embodiment, the protuberances are designed and fabricated to treat a subject afflicted with pain in the pes anserinus region during heel-strike. In such case, the location of the peak of the posterior protuberance is selected to be at the middle of the centerline of the assembled footwear. In another embodiment, the protuberances are designed and fabricated to treat a subject afflicted with pain in the pes anserinus region during Mid-stance/Toe-off. In such case, the location of the peak of the anterior protuberance is selected to be at the middle of the centerline of the assembled footwear.

In another embodiment, the protuberances are designed and fabricated to treat a subject afflicted with pain in the medial aspect of patella during heel-strike. In such case, the location of the peak of the posterior protuberance is selected to be anteriorly (forward) towards the latitude of the assembled footwear.

In another embodiment, the protuberances are designed and fabricated to treat a subject afflicted with pain in the medial aspect of patella during Mid-stance/Toe-off. In such case, the location of the peak of the anterior protuberance is selected to be posteriorly towards the anterior end of the calcaneus of the assembled footwear.

In another embodiment, the protuberances are designed and fabricated to treat a subject afflicted with pain in the lateral aspect of patella during heel-strike. In such case, the location of the peak of the posterior protuberance is selected to be anteriorly (forward). In another embodiment, the protuberances are designed and fabricated to treat a subject afflicted with pain in the lateral aspect of patella during Mid-stance/Toe-off. In such case, the location of the peak of the anterior protuberance is selected to be posteriorly to the centerline.

In another embodiment, the protuberances are designed and fabricated to treat a subject afflicted with pain in the supra patellar region during heel-strike. In such case, the location of the peak of the posterior protuberance is selected to be anteriorly with respect to the at least one recess. In another embodiment, the protuberances are designed and fabricated to treat a subject afflicted with pain in the supra patellar region during Mid-stance/Toe-off. In such case, the location of the peak of the anterior protuberance is selected to be posteriorly to the centerline.

In another embodiment, assembled footwear 100 alleviates pain in the medial femoral condyle region. In another embodiment, assembled footwear 100 alleviates pain during heel-strike. In another embodiment, assembled footwear 100 alleviates pain during mid-stance/Toe-off. In another embodiment, assembled footwear 100 alleviates pain in the medial femoral condyle region. In another embodiment, assembled footwear 100 alleviates pain in the medial proximal aspect of tibia region. In another embodiment, assembled footwear 100 alleviates pain in the lateral proximal aspect of tibia region. In another embodiment, assembled footwear 100 alleviates pain in the region of insertion of medial head of gastrocnemius. In another embodiment, assembled footwear 100 alleviates pain in the region of insertion of the Achilles tendon. In another embodiment, assembled footwear 100 alleviates pain in the region of insertion of medial hamstring. In another embodiment, assembled footwear 100 alleviates pain in the region of insertion of lateral hamstring. In another embodiment, assembled footwear 100 alleviates pain in the region of insertion of lateral head of gastrocnemius. Each possibility represents a separate embodiment of the present invention.

In another embodiment, a lower limb musculoskeletal pain or disorder such as described herein creates a gait disorder that is treatable according to the methods described herein.

General Indications

In some embodiments, the use of the assembled footwear disclosed herein is directed to methods of controlling or manipulating at least one gait parameter. In some embodiments, the gait parameter is selected from foot alignment, knee alignment, velocity, step length, swing and stance phase, double support time, ground reaction forces, impulse, propulsion during habitual walking, kneed alignment, center of pressure, symmetry, gait speed, step time, step length, stride length, step width, foot angle, demarcation between walking and running, and the like. In one embodiment, the one or more protuberances of the assembled footwear disclosed herein are designed to manipulate, the step length, which is the length measured parallel to the Line of Progression of the body, from the posterior contact (heel) of the previous footfall to the posterior contact (heel) of the current opposing footfall. In one embodiment, the one or more protuberances of the assembled footwear disclosed herein are designed to manipulate the stride length, which is the distance measured parallel to the Line of Progression, between the Posterior Heel points of two consecutive footprints of the foot in question. In one embodiment, the one or more protuberances of the assembled footwear disclosed herein are designed to manipulate the step width, which is the distance measured between line of progression of the left foot and the line of progression of the right foot. In one embodiment, the one or more protuberances of the assembled footwear disclosed herein are designed to manipulate the foot angle, which is the angle between the line of progression and the foot axis. Foot Angle is zero when the foot axis is parallel to the line of progression. The Foot Angle is positive when the foot axis points lateral to the line of progression. The Foot Angle is negative when the foot axis points medial to the line of progression. Each possibility represents a separate embodiment of the present invention.

In some embodiments, the one or more protuberances of the assembled footwear disclosed herein are shaped/configured to put a use in a balanced position. The balanced position being a position whereby the assembled footwear provides a reduced and/or minimum inversion or a reduced and/or minimum eversion to the subject's foot during the stance phases.

In some embodiments, the one or more protuberances of the assembled footwear disclosed herein are designed to manipulate the balance of each foot of the subject and/or the total balance of the subject. In one embodiment, the one or more protuberances of the assembled footwear disclosed herein are designed to manipulate the balance of both feet during standing. In one embodiment, the one or more protuberances of the assembled footwear disclosed herein are designed to manipulate the balance of both feet during walking. In one embodiment, the one or more protuberances disclosed herein are designed to manipulate the balance of both feet during running. In one embodiment, the one or more protuberances of the assembled footwear disclosed herein are designed to manipulate the balance of each foot separately.

A Degenerative Joint Disease

In one embodiment, the one or more protuberances of the assembled footwear disclosed herein are designed to treat a lower limb joint pathology comprising: a lower limb joint disease, a lower limb joint degenerative disease, a lower limb degenerative disease, a lower limb musculoskeletal pathology, a lower limb musculoskeletal trauma, a lower limb musculoskeletal disease, lower limb osteoarthritis, or any combination thereof. In another embodiment, a lower limb joint pathology is associated with lower limb musculoskeletal pain.

In another embodiment, a lower limb joint pathology is a hip, an ankle, a foot, or a knee degenerative joint disease. In another embodiment, a lower limb joint pathology comprises a degenerative joint disease such as osteoarthritis. In another embodiment, osteoarthritis is idiopathic osteoarthritis. In another embodiment, a degenerative joint disease is lower limb osteoarthritis. In another embodiment, a degenerative joint disease is knee osteoarthritis. In another embodiment, a hip, an ankle, a foot, or knee osteoarthritis is primary osteoarthritis. Each possibility represents a separate embodiment of the present invention.

In another embodiment, a degenerative joint disease is foot osteoarthritis. In another embodiment, a degenerative joint disease is hip osteoarthritis. In another embodiment, osteoarthritis is secondary osteoarthritis. In another embodiment, knee osteoarthritis is secondary knee osteoarthritis. In another embodiment, classification into either primary or secondary depends on if there is or is not an identifiable underlying cause. Each possibility represents a separate embodiment of the present invention.

In another embodiment, a lower limb joint pathology is patellar compression. In another embodiment, a lower limb joint pathology is joint line tenderness. In another embodiment, a lower limb joint pathology is joint line effusion. In another embodiment, a lower limb joint pathology is patellar tendonitis. In another embodiment, a lower limb joint pathology is infrapatellar tendonitis. In another embodiment, a lower limb joint pathology is pain and/or tenderness in any patellar or prepatellar anatomical structure. Each possibility represents a separate embodiment of the present invention. In another embodiment, tendonitis is tendon degeneration. In another embodiment, tendonitis is tendinosis. In another embodiment, tendonitis is pain arising from the tendon due degenerative changes in the tendon.

In another embodiment, a lower limb joint pathology is a lower limb degenerative joint disease. In another embodiment, a lower limb joint pathology is medial/lateral/patella-femoral osteoarthritis (OA) or any combination thereof (primary or secondary). In another embodiment, a lower limb joint pathology is Pes-anserinus bursitis. In another embodiment, a lower limb joint pathology is characterized by anterior knee pain and/or patello-femoral pain. In another embodiment, a lower limb joint pathology is a meniscal tear (both degenerative and traumatic). In another embodiment, a lower limb joint pathology is ligament tear/partial tear/strain/post reconstruction (ACL, PCL, MCL, LCL), or any combination thereof. In another embodiment, a lower limb joint pathology includes pre/post arthroplasty including total, hemi, or resurfacing and use of the methods as described herein. In another embodiment, a lower limb joint pathology is tibial plateau fracture. In another embodiment, a lower limb joint pathology is osteonecrosis (both in the tibia and femur). In another embodiment, a lower limb joint pathology is Patelar tendonitis. In another embodiment, a lower limb joint pathology is Osgood schlatter. In another embodiment, a lower limb joint pathology comprises post lower limb surgery. Each possibility represents a separate embodiment of the present invention.

In another embodiment, a lower limb joint pathology is hip replacement. In another embodiment, a lower limb joint pathology is hip resurfacing. In another embodiment, a lower limb joint pathology is pre-patellar bursitis. In another embodiment, a lower limb joint pathology is trochanteric bursitis. In another embodiment, a lower limb joint pathology comprises necrosis within the lower limb joint. In another embodiment, a lower limb joint pathology comprises hip fracture. In another embodiment, a lower limb joint pathology comprises developmental dysplasia of the hip. In another embodiment, a lower limb joint pathology comprises tendonitis/tendinosis of the hip. In another embodiment, a lower limb joint pathology comprises impingement of the hip. Each possibility represents a separate embodiment of the present invention.

In another embodiment, a lower limb joint pathology comprises Osteochondritis dissecans of the foot or ankle. In another embodiment, a lower limb joint pathology comprises acute or chronic instability of the foot or ankle. In another embodiment, a lower limb joint pathology comprises Ligament Sprain, tear, and/or repair within a joint of the foot or ankle. In another embodiment, a lower limb joint pathology comprises a foot or ankle fracture. In another embodiment, a lower limb joint pathology comprises Plantar Fascitis. In another embodiment, a lower limb joint pathology comprises Tibialis posterior insufficiency and/or dysfunction. In another embodiment, a lower limb joint pathology comprises a pronating foot. In another embodiment, a lower limb joint pathology comprises a supinating foot. In another embodiment, a lower limb joint pathology comprises of pes planus or pes cavus. Each possibility represents a separate embodiment of the present invention.

In another embodiment, a lower limb joint pathology comprises ilio-tibial band (ITB) syndrome. In another embodiment, a lower limb joint pathology comprises hyperlaxity or hypermobility. In another embodiment, a lower limb joint pathology comprises muscular atrophy. In another embodiment, a lower limb joint pathology comprises tumors within a lower limb. In another embodiment, a lower limb joint pathology comprises tumors which affect a joint of the lower limb. Each possibility represents a separate embodiment of the present invention.

In another embodiment, treating or treatment according to the invention comprises diminishing, alleviating, reducing, inhibiting, improving, reversing, and/or ameliorating: pain, stiffness, swelling, inflammation, cartilage degeneration, osteophytes, narrowing of joint space, effusion, muscular atrophy, deterioration of neuro-muscular control, deterioration of proprioception bracing, pathological moments, gait disorders, limping, compensatory gait, antalgic gait, asymmetry in gait, guarding of muscles, loosening of ligaments, loosening of joint capsule, stretching of ligaments, stretching of joint capsule, reduced step length, reduced single limb support, increased single limb support, reduced gait velocity, or any combination thereof. In another embodiment, treating or treatment according to the invention comprises diminishing, alleviating, reducing, inhibiting, improving, reversing, and/or ameliorating bone marrow edema, lesions, subchondral bone changes, softening of cartilage, fibrillating and thinning of cartilage, eburnation of the bone, or any combination thereof. Each possibility represents a separate embodiment of the present invention.

In another embodiment, treating or treatment comprise performing a variety of maneuvers in a proprioceptive and/or kinesthetic exercise plan for the foot, leg, upper leg, lower back and even upper torso and other body parts and organs. In another embodiment, treating or treatment comprise performing a variety of walking and or gait exercise plan for the foot, upper leg, lower back and even upper torso and other body parts and organs. Each possibility represents a separate embodiment of the present invention.

In another embodiment, the subject is suffering from pain stemming from a lower limb joint pathology. In another embodiment, the subject is suffering from pain, a joint pain, tenderness, stiffness, locking, an effusion, or any combination thereof. In another embodiment, the subject is suffering from loss of cartilage. In another embodiment, the subject is suffering from a decreased movement secondary to pain. In another embodiment, the subject is suffering from regional muscles atrophy. In another embodiment, the subject is suffering from lax ligaments. In another embodiment, the subject is suffering from crackling noise ("crepitus") when the affected joint is moved or touched. In another embodiment, the subject is suffering from muscle spasm or bracing. In another embodiment, the subject is suffering from tendons contractions. In another embodiment, the methods as described alleviate a painful joint. In another embodiment, the methods as described treat the underlying causes of joint pain. Each possibility represents a separate embodiment of the present invention.

Osteoarthritis

In one embodiment, the one or more protuberances of the assembled footwear disclosed herein are designed to treat osteoarthritis. In another embodiment, the subject is suffering from lower limbs osteoarthritis. In another embodiment, the subject is suffering from hips osteoarthritis. In another embodiment, the subject is suffering from spine osteoarthritis. In another embodiment, the subject is suffering from feet osteoarthritis. In another embodiment, the subject is suffering from a joint effusion (water in the knee in lay terms). Each possibility represents a separate embodiment of the present invention.

In another embodiment, the subject is at risk of being afflicted with osteoarthritis. In another embodiment, the subject is exposed to elevated mechanical stress on the joints. In another embodiment, the subject is afflicted with misalignments of bones caused by congenital or pathogenic causes. In another embodiment, the subject is overweight or obese. In another embodiment, the subject suffers from loss of strength in muscles supporting joints, impairment of peripheral nerves, uncoordinated movements that overstress joints, ligaments, muscles, tendons, or any combination thereof. Each possibility represents a separate embodiment of the present invention.

In another embodiment, the subject is afflicted with osteophytes. In another embodiment, the methods as described herein inhibit narrowing of the joint space. In another embodiment, the methods as described herein expand the joint space. In another embodiment, the methods as described herein inhibit increased subchondral bone density. In another embodiment, the methods as described herein decrease subchondral bone density. In another embodiment, the methods as described herein increase the water content of the cartilage. In another embodiment, the methods as described herein increase proteoglycan content of the cartilage. In another embodiment, the methods as described herein inhibit inflammation of the surrounding joint capsule. In another embodiment, the methods as described herein inhibit "spurs" or osteophytes that form on the margins of the joints. In another embodiment, the methods as described herein are used as a prevention measure for subjects at risk of being afflicted with osteoarthritis. In another embodiment, subjects at risk of being afflicted with osteoarthritis are subjects of whose siblings are afflicted with osteoarthritis. Each possibility represents a separate embodiment of the present invention.

In another embodiment, osteoarthritis is primary generalized nodal osteoarthritis. In another embodiment, osteoarthritis is erosive osteoarthritis. In another embodiment, osteoarthritis is inflammatory osteoarthritis. In another embodiment, osteoarthritis is secondary osteoarthritis that is caused by other factors but the resulting pathology is the same as for primary osteoarthritis. Each possibility represents a separate embodiment of the present invention.

In another embodiment, lower limb osteoarthritis (OA) is characterized by pain, stiffness, swelling, inflammation, cartilage degeneration, osteophytes, narrowing of joint space, effusion, muscular atrophy, deterioration of neuromuscular control, deterioration of proprioception, bracing, pathological moments, gait disorders, limping, compensatory gait, antalgic gait, asymmetry in gait, guarding of muscles, loosening of ligaments, loosening of joint capsule, stretching of ligaments, stretching of joint capsule, reduced step length, or any combination thereof. Each possibility represents a separate embodiment of the present invention.

Lower Limb Musculoskeletal Pain

In another embodiment, "pain" as used herein comprises a sharp ache. In another embodiment, "pain" as used herein comprises a burning sensation in the associate muscles and tendons. In another embodiment, "pain" as used herein comprises continuous pain. In another embodiment, "pain" as used herein comprises is a momentary pain. In another embodiment, "pain" as used herein comprises seasonal pain (winter, summer or change of weather). In another embodiment, "pain" as used herein comprises activity specific pain such as sports or any other physical activity related pain. Each possibility represents a separate embodiment of the present invention.

In another embodiment, lower limb musculoskeletal pain comprises anterior knee pain. In another embodiment, lower limb musculoskeletal pain comprises patello-femoral knee pain. Each possibility represents a separate embodiment of the present invention.

In another embodiment, a lower limb musculoskeletal pain arises from two types of trauma, acute trauma and cumulative (overuse) trauma. In another embodiment, acute traumas occur when the load imposed on the body during a task exceeds the tolerance of the body structures supporting it. In another embodiment, a lower limb musculoskeletal pain is associated with large single loading conditions. In another embodiment, a lower limb musculoskeletal pain is a violent lateral impact on a joint such as but not limited to the knee. In another embodiment, a lower limb musculoskeletal pain is an infrequent extreme force exertion on a joint. In another embodiment, overuse trauma, occurs when the load imposed on the body during a task is not large enough to cause sudden failure of one or other of the underlying body structures (bone, the muscles, tendons and ligaments) but instead these structures are worn down and their tolerance lowered with repeated application of the load. In another embodiment, a lower limb musculoskeletal pain is caused by "wear and tear" on the bodily structures. Each possibility represents a separate embodiment of the present invention.

In another embodiment, a lower limb musculoskeletal pain arises from stress fractures and shin splints. In another embodiment, a lower limb musculoskeletal pain arises from ankle and metacarpal fractures (acute injuries). In another embodiment, a lower limb musculoskeletal pain arises from bursitis. In another embodiment, a lower limb musculoskeletal pain arises from rheumatism. In another embodiment, a lower limb musculoskeletal pain arises from cartilage tear. Each possibility represents a separate embodiment of the present invention.

In another embodiment, a lower limb musculoskeletal pain is a consequence of lower limb osteoarthritis. In another embodiment, a lower limb musculoskeletal pain is a consequence of Piriformis syndrome. In another embodiment, a lower limb musculoskeletal pain is a consequence of Trochanteritis. In another embodiment, a lower limb musculoskeletal pain is sacroiliac pain. In another embodiment, a lower limb musculoskeletal pain causes palpable tenderness of the trochanter major. In another embodiment, a lower limb musculoskeletal pain is caused by hamstring muscle strain. In another embodiment, a lower limb musculoskeletal pain is caused by hamstring injuries. Each possibility represents a separate embodiment of the present invention.

In another embodiment, a lower limb musculoskeletal pain is a direct consequence of bursitis. In another embodiment, a lower limb musculoskeletal pain is a direct consequence of a beat knee (Hyperkeratosis). In another embodiment, a lower limb musculoskeletal pain is a direct consequence of a meniscal lesion. In another embodiment, a lower limb musculoskeletal pain is a direct consequence of meniscal damage. In another embodiment, a lower limb musculoskeletal pain is a direct consequence of a degenerative joint disease. In another embodiment, a lower limb musculoskeletal pain is a direct consequence of a lower limb degenerative joint disease. Each possibility represents a separate embodiment of the present invention.

In another embodiment, a lower limb musculoskeletal pain is a direct consequence of bursitis (Adventitious, prepatellar, etc). In another embodiment, bursitis develops in response to frictional stress that is applied directly over the bursa of the knees. In another embodiment, bursitis is pyogenic bursitis. In another embodiment, a lower limb musculoskeletal pain is associated with tenderness and swelling over the patella. Each possibility represents a separate embodiment of the present invention.

In another embodiment, a lower limb musculoskeletal pain is a direct consequence of hyperkeratosis. In another embodiment, hyperkeratosis is an acute and extreme form of bursitis. Each possibility represents a separate embodiment of the present invention.

In another embodiment, a lower limb musculoskeletal pain is a direct consequence of meniscal lesions and/or damage. In another embodiment, meniscal lesions/damage usually occurs due to high rates of force being applied to the knee, or heavy rotational force, e.g. when the knee is bent or twisted while bearing load. Each possibility represents a separate embodiment of the present invention.

In another embodiment, a lower limb musculoskeletal pain is a direct consequence of stress fracture/stress reaction injuries. In another embodiment, the term 'stress reaction' refers to bone with evidence of remodeling but with an absence of radiological evidence of fracture. In another embodiment, stress reaction/fracture is the result of repeated micro-injuries to bone, which occur when its maximum strength is exceeded by an applied force and the natural process by which bone adapts to stress is prevented. In another embodiment, stress fracture is associated with the tibia or femur or foot. In another embodiment, stress fracture is associated with the fibula. Each possibility represents a separate embodiment of the present invention.

In another embodiment, a lower limb musculoskeletal pain is a direct consequence of a sprained ankle. In another embodiment, a lower limb musculoskeletal pain is a direct consequence of an anterior compartment syndrome. In another embodiment, a lower limb musculoskeletal pain is a direct consequence of a lateral compartment syndrome. In another embodiment, a lower limb musculoskeletal pain is a direct consequence of a plantar Fasciitis. In another embodiment, a lower limb musculoskeletal pain is a direct consequence of an Achilles Tendonitis. In another embodiment, a lower limb musculoskeletal pain is a direct consequence of a foot corns. In another embodiment, a lower limb musculoskeletal pain is a direct consequence of Halux Valgus. In another embodiment, a lower limb musculoskeletal pain is a direct consequence of interdigital neuroma. In another embodiment, a lower limb musculoskeletal pain is a direct consequence of tarsal tunnel syndrome. In another embodiment, a lower limb musculoskeletal pain is a direct consequence of a lesser toe deformity. In another embodiment, a lower limb musculoskeletal pain is a direct consequence of psoriatic arthritis. Each possibility represents a separate embodiment of the present invention.

In another embodiment, a lower limb musculoskeletal pain is heel pain. In another embodiment, a lower limb musculoskeletal pain is a direct consequence of an acquired flatfoot. In another embodiment, a lower limb musculoskeletal pain is associated with a putative genesis in abnormal foot pronation. In another embodiment, a lower limb musculoskeletal pain is associated with defective gait patterns. In another embodiment, a lower limb musculoskeletal pain is associated with defective stance. Each possibility represents a separate embodiment of the present invention.

Spinal Related Pathologies

In another embodiment, the one or more protuberances of the assembled footwear may be designed to treat a subject suffering from a spinal disorder, a spinal pathology, a spinal injury, and/or a spinal related pathology.

In another embodiment, the one or more protuberances of the assembled footwear may be designed to improve the proprioception and/or kinesthetic control in walking in a subject described herein having a spinal pathology. In another embodiment, changing the center of pressure (COP) with which the foot contacts the ground, spinal pathologies and/or spinal pathologies related effects such as pain or defective gait can be treated and even cured. In another embodiment, changing the center of pressure (COP) with which the foot contacts the ground is executed through calibrating the device (footwear) of the invention. In another embodiment, COP is changed or altered via a perturbation induced by a protuberance as disclosed herein. In another embodiment, a device of the invention alters COP thus changing the movement pattern of a lower limb. In another embodiment, the one or more protuberances of the assembled footwear are designed to alter COP thus changing the movement pattern of the lower back muscles. In another embodiment, a device of the invention alters COP thus changing the movement or load pattern of the spine and neighboring musculoskeletal tissues. In another embodiment, the one or more protuberances of the assembled footwear are designed to provide a controlled change in movement pattern and concomitantly avoiding damage, injury, trauma, or a combination thereof (such as but not limited to: falls, damaging gait, damaging lower limb neuromuscular control or activity) to the subject using the assembled footwear, thus efficiently enabling the accomplishment of the methods provided herein. Each possibility represents a separate embodiment of the present invention.

Urinary Incontinence

In another embodiment, an assembled footwear as described herein is used for treating a subject suffering from a urinary incontinence. an assembled footwear as described herein is used for treating a subject suffering from a high urinary frequency. In another embodiment, an assembled footwear as described herein is used for treating a subject suffering from urgent urination which is a sudden, compelling urge to urinate, along with discomfort in the bladder. In another embodiment, an assembled footwear as described herein is used for treating a subject suffering from frequent need to urinate at night (nocturia).

In another embodiment, a subject suffering from urinary incontinence or frequent urination is a woman during menopause. In another embodiment, a subject suffering from urinary incontinence is a post-menopausal woman.

In another embodiment, the subject that can benefit from treatment with the assembled footwear described herein is further afflicted with benign prostatic hyperplasia, congestive heart failure, cystocele, diabetes, diabetes insipidus, overactive bladder, prostate cancer, diabetes insipidus-central, diabetes insipidus-nephrogenic, diabetes mellitus (type 1 or type 2), excessive intake of a high solute load (such as mannitol therapy in the hospital, or use of radiocontrast materials for radiology procedures), salt wasting kidney diseases (such as Bartter's syndrome), excessive fluid intake, use of diuretics, interstitial cystitis, multiple sclerosis, Parkinson's disease, post kidney stones, urethral strictures, urinary tract infections, anatomical abnormalities, overactive bladder (also called urge incontinence, which can be result from infection, cystitis, bladder tumors, or neurogenic bladder), a psychological factor, stress incontinence (which may be related to pregnancy, estrogen deficiency or pelvic surgery), damage from prostate surgery, neurogenic bladder, atrophic urethritis, delirium, or any combination thereof.

In another embodiment, the subject that can benefit from treatment with the assembled footwear described herein is suffering from muscle atrophy. In another embodiment, the subject that can benefit from treatment with the assembled footwear described herein is suffering from cachexia. In another embodiment, the subject that can benefit from treatment with the assembled footwear described herein is suffering from a congestive heart disease.

In another embodiment, the subject that can benefit from treatment with the assembled footwear described herein is suffering from weak pelvic floor muscles which fail to retain the urine in the bladder when intra-abdominal pressure rises (ex. cough, laugh etc.). In another embodiment, the subject that can benefit from treatment with the assembled footwear described herein is suffering from urge incontinence or the inability to control urine passing when feeling the need to urinate. In another embodiment, the subject that can benefit from treatment with the assembled footwear described herein is suffering from overflow incontinence. In another embodiment, overflow incontinence occurs when urine continues to pass long after the subject has finished urinating. In another embodiment, the subject that can benefit from treatment with the assembled footwear described herein is suffering from mixed incontinence.

In another embodiment, the subject that can benefit from treatment with the assembled footwear described herein is a woman suffering from urinary stress incontinence, urinary urge incontinence, mixed urinary incontinence, overflow urinary incontinence or a combination thereof.

Neurological Conditions or Symptoms

According to some embodiments, a kit and/or assembled footwear for the treatment of neurological conditions or symptoms related thereto is provided. In one embodiment, the one or more protuberances of the assembled footwear are designed to improve balance of a subject afflicted with a neurological condition via improved muscle coordination, motor learning, normalized gait pattern, desired alignment of the joints in the lower limb and low back. For example, the one or more protuberances of the assembled footwear are designed to improve dysmetria of a subject having a neurological condition, via mechanism of brain plasticity, motor learning, improved and more precise proprioception and interpretation of proprioceptive and vestibular input as well as improved muscle coordination and/or neurological coordination of a subject afflicted with a neurological condition. For example, the one or more protuberances of the assembled footwear are designed to reduce muscle tone of a subject having a neurological condition, via desired alignment of the joints in the lower limb and low back, reduced muscle bracing as a response to the innate perturbation of a subject afflicted with a neurological condition. For example, the one or more protuberances of the assembled footwear are designed to reduce the energy cost of gait of a subject afflicted with a neurological condition, via improved muscle coordination, motor learning, normalized gait pattern, desired alignment of the joints in the lower limb and low back in a subject afflicted with a neurological condition. For example, the one or more protuberances of the assembled footwear are designed to increase neuronal sprouting of a subject afflicted with a neurological condition, via repetitive stimulation of a desired movement pattern (central nervous system) and repeated muscular activation (peripheral nervous system). For example, the one or more protuberances of the assembled footwear are designed to increase neurological system plasticity of a subject afflicted with a neurological condition. For example, the one or more protuberances of the assembled footwear are designed to prevent joint pain, deformity and contractures (both in the joint and various muscles) of a subject having a neurological disorder, via redistribution of loads in the joints, improved muscular activity and reduced muscle tone. For example, the one or more protuberances of the assembled footwear are designed to prevent falls of a subject afflicted with a neurological condition, via improved balance, reduced muscle tone, improved dysmetria, improved alignment and posture.

In some embodiments, the kit and/or assembled footwear disclosed herein is used in methods of improving the control over gait function. In some embodiments, the design of the one or more protuberances of the assembled footwear is based on the unexpected discovery that by changing the center of pressure (COP) with which the foot contacts the ground, various gait related conditions caused by neurological disorders can be treated, improved and/or completely cured. In another embodiment, changing the center of pressure (COP) with which the foot contacts the ground is executed through calibrating the device (footwear) of the invention. In another embodiment, COP is changed or altered via a perturbation induced by a protuberance as disclosed herein. In another embodiment, the one or more protuberances of the assembled footwear are designed to alters COP thus changing the movement pattern of a lower limb. In another embodiment, the one or more protuberances of the assembled footwear are designed to provide a controlled change in movement pattern and concomitantly avoiding damage, injury, trauma, or a combination thereof (such as but not limited to: falls, damaging gait, damaging lower limb neuromuscular control or activity) to the subject using the device, thus efficiently enabling the accomplishment of the methods provided herein.

The Subject

In another embodiment, a subject is an athlete. In another embodiment, a subject suffers from pain such as lower limb pain, back pain or a neuropathic pain.

In another embodiment, the subject is afflicted with a congenital disorder of joints. In another embodiment, the subject is afflicted with diabetes. In another embodiment, the subject is afflicted with inflammatory diseases (such as Perthes' disease, Lyme disease, a chronic form of arthritis). Each possibility represents a separate embodiment of the present invention.

In another embodiment, the subject is afflicted with rheumatoid arthritis. In another embodiment, the subject is afflicted with Achilles tendon injuries and Tendonitis In another embodiment, the subject is afflicted with adductor strain. In another embodiment, the subject is afflicted with an ankle sprain. In another embodiment, the subject is afflicted with anterior cruciate ligament injury. In another embodiment, the subject is afflicted with calcaneal bursitis. In another embodiment, a lower limb musculoskeletal pain is coccyx pain. In another embodiment, the subject is afflicted with compartment syndrome. In another embodiment, the subject is afflicted with iliotibial band syndrome. In another embodiment, the subject is afflicted with medial collateral and lateral collateral ligament injury. In another embodiment, the subject is afflicted with Meralgia Paresthetica. In another embodiment, the subject is afflicted with Morton Neuroma. In another embodiment, the subject is afflicted with Osteitis Pubis. In another embodiment, the subject is afflicted with patellofemoral syndrome. In another embodiment, the subject is afflicted with Pes Anserinus bursitis or tendonitis. In another embodiment, the subject is afflicted with Piriformis syndrome. In another embodiment, the subject is afflicted with plantar Fasciitis. In another embodiment, the subject is afflicted with posterior cruciate ligament injury. In another embodiment, the subject is afflicted with prepatellar bursitis. In another embodiment, the subject is afflicted with Trochanteric bursitis. Each possibility represents a separate embodiment of the present invention.

In another embodiment, a subject according to the invention further suffers from a gait disorder. In another embodiment, a subject according to the invention is a human subject that can walk or run with a device as described herein. In another embodiment, a subject according to the invention is a human subject that can walk or run with footwear 10. Each possibility represents a separate embodiment of the present invention. In another embodiment, a gait disorder is asymmetry of gait, shuffling gait, gait with lurching actions, or any combination thereof. In another embodiment, a gait disorder is caused by a degenerative joint disease. Each possibility represents a separate embodiment of the present invention.

In another embodiment, the subject is able to walk. In another embodiment, the subject is able to walk with a walking aid such as but not limited to a walking cane. In another embodiment, the subject is able to walk independently. In another embodiment, walk is defined as the act of shifting the balance and base of support from one foot to the other while progressing in a certain direction. Each possibility represents a separate embodiment of the present invention.

Treatment

In another embodiment, the method as described herein involves exercise with the assembled footwear as described herein. In another embodiment, exercise is walking or any other form of gait movement. In another embodiment, improvement in measured in a gait lab. In another embodiment, improvement in subject's physical state is observed by using the methods described herein. In another embodiment, treating is improvement in subject's physiological state. In another embodiment, treating is improvement in subject's mental state. In another embodiment, treating is improvement in subject's wellbeing. In another embodiment, treating is relieving pain such as joint pain. In another embodiment, treating is relieving tenderness. In another embodiment, treating is relieving stiffness. In another embodiment, treating is relieving locking. In another embodiment, treating is relieving an effusion. In another embodiment, treating is inhibiting loss of cartilage. In another embodiment, treating is inducing de-novo cartilage build-up. In another embodiment, treating is increasing movement. In another embodiment, treating is increasing movement secondary to pain. In another embodiment, treating is inhibiting regional muscles atrophy. In another embodiment, treating is reversing regional muscles atrophy. In another embodiment, treating is inducing muscle build-up. In another embodiment, treating is inducing differential muscle build-up. Each possibility represents a separate embodiment of the present invention.

In another embodiment, treating is improving gait. In another embodiment, treating is improving balance. In another embodiment, treating is improving impairments of proprioception, balance, strength, or any combination thereof. In another embodiment, treating is reversing impairments of proprioception, balance, strength, or any combination thereof. In another embodiment, treating is specifically improving impairments of proprioception, balance, strength, or any combination thereof associated with a specific degenerative joint disease. In another embodiment, treating is specifically improving impairments of proprioception, balance, strength, or any combination thereof associated with lower extremity arthritis. In another embodiment, treating is specifically improving impairments of proprioception, balance, strength, or any combination thereof associated with a hip, an ankle, a foot, or knee osteoarthritis. In another embodiment, treating is reducing falls. Each possibility represents a separate embodiment of the present invention.

In another embodiment, treating is manipulating a step length. In another embodiment, treating is decreasing "step length difference". In another embodiment, treating is manipulating single limb support. In another embodiment, treating is manipulating out/in towing angle. In another embodiment, treating is calibrating gait cycle (40:40:20). In another embodiment, treating is manipulating cadence. In another embodiment, treating is manipulating the center of pressure (COP). In another embodiment, treating is correcting mean hip motion, knee motion, ankle motion, or any combination thereof in the sagittal, frontal, and transverse planes. In another embodiment, treating is improving walking pace or speed. In another embodiment, treating is enhancing walking pace or speed. In another embodiment, improving walking pace or speed is reaching a goal of walking speed of 1.6-4 km/hour. In another embodiment, improving walking pace or speed is reaching a goal of walking speed of 1.6-4 km/hour for at least 2 minutes. In another embodiment, improving walking pace or speed is reaching a goal of walking speed of 1.6-4 km/hour for at least 5 minutes. In another embodiment, improving walking pace or speed is reaching a goal of walking speed of 1.6-4 km/hour for at least 10 minutes. In another embodiment, improving walking pace or speed is reaching a goal of walking speed of 1.6-4 km/hour for at least 15 minutes. In another embodiment, improving walking pace or speed is reaching a goal of walking speed of 2-3.5 km/hour for at least 2 minutes. In another embodiment, improving walking pace or speed is reaching a goal of walking speed of 2-3.5 km/hour for at least 5 minutes. In another embodiment, improving walking pace or speed is reaching a goal of walking speed of 2-3.5 km/hour for at least 10 minutes. In another embodiment, improving walking pace or speed is reaching a goal of walking speed of 2-3.5 km/hour for at least 15 minutes. In another embodiment, improving walking pace or speed is reaching a goal of walking speed of 2.5-3.2 km/hour for at least 2 minutes. In another embodiment, improving walking pace or speed is reaching a goal of walking speed of 2.5-3.2 km/hour for at least 5 minutes. In another embodiment, improving walking pace or speed is reaching a goal of walking speed of 2.5-3.2 km/hour for at least 10 minutes. In another embodiment, improving walking pace or speed is reaching a goal of walking speed of 2.5-3.2 km/hour for at least 15 minutes. Each possibility represents a separate embodiment of the present invention.

In another embodiment, treating is relaxing a stiff knee, hip, ankle, or foot. In another embodiment, treating is correcting an abnormal flexion or extension in stance phase. In another embodiment, treating is correcting a restriction of hip extension in toe-off. In another embodiment, treating is correcting an abnormal muscle activity of the lower limb. In another embodiment, treating is correcting overactivity of quadriceps in stance. In another embodiment, treating is correcting (shortening or lengthening) semitendinosus activity. In another embodiment, treating is correcting exaggerated triceps surae activity in swing. In another embodiment, treating is correcting a silent tibialis anterior in terminal swing. In another embodiment, treating is toning any lower limb muscle. Each possibility represents a separate embodiment of the present invention.

In another embodiment, the methods as described herein further comprises a combination treatment comprising the use of the assembled footwear as described herein and a proper medication. In another embodiment, one of skill in the art will readily diagnose and prescribe the proper medication to a subject suffering from a disease or a condition such as described herein. In another embodiment, the medication is an analgesic such as acetaminophen. In another embodiment, the medication is a non-steroidal anti-inflammatory drug (NSAID) such as ibuprofen. In another embodiment, the medication is a COX-2 selective inhibitor such as celecoxib. In another embodiment, the medication is a topical NSAID such as diclofenac. In another embodiment, the medication is an opioid analgesic such as morphine or codeine. In another embodiment, the medication is a glucocorticoid such as hydrocortisone injected into the knee. In another embodiment, the medication is topical capsaicin. In another embodiment, the medication is a joint injection of hyaluronic acid. Each possibility represents a separate embodiment of the present invention.

In another embodiment, the outcome of treatment as provided herein is apparent immediately after the initial use of the assembled footwear as described herein. In another embodiment, the outcome of treatment as provided herein is apparent after 10-1000000 meters of walking with the assembled footwear as described herein. In another embodiment, the outcome of treatment as provided herein is apparent after 50-100000 meters of walking with the assembled footwear as described herein. In another embodiment, the outcome of treatment as provided herein is apparent after 500-10000 meters of walking with the assembled footwear as described herein. In another embodiment, the outcome of treatment as provided herein is apparent after 500-5000 meters of walking with the assembled footwear as described herein. In another embodiment, the outcome of treatment as provided herein is apparent after 500-3000 meters of walking with the assembled footwear as described herein. Each possibility represents a separate embodiment of the present invention.

In another embodiment, the outcome of treatment as provided herein is correction of a pathology related to lower limb osteoarthritis. In another embodiment, the outcome of treatment as provided herein is correction of a hip, an ankle, a foot, or a knee osteoarthritis. In another embodiment, the outcome of treatment as provided herein is elevating lower limb osteoarthritis. In another embodiment, the outcome of treatment as provided herein is inhibiting symptoms associated with lower limb osteoarthritis. Each possibility represents a separate embodiment of the present invention.

In another embodiment, the outcome of treatment as provided herein is apparent while the subject is wearing the assembled footwear as described herein. In another embodiment, the outcome of treatment as provided herein is apparent also when the subject is walking barefoot. Each possibility represents a separate embodiment of the present invention.

In another embodiment, differential muscle build-up comprises inducing muscle build-up in regions of muscles atrophy. In another embodiment, differential muscle build-up comprises inducing muscle build-up in regions of muscles weakness. In another embodiment, differential muscle build-up comprises inducing muscle build-up in regions of muscles injury. Each possibility represents a separate embodiment of the present invention.

In another embodiment, a assembled footwear as disclosed herein has an immediate effect with regard to treating or treatment of a disease, a pathology, and/or pain as provided herein. In another embodiment, short term immediate effect is apparent in a barefoot subject after walking with the assembled footwear for 1-5 minutes. In another embodiment, a assembled footwear as disclosed herein has an immediate effect with regard to treating or treatment of a disease, a pathology, and/or pain as provided herein. In another embodiment, short term immediate effect is apparent in a barefoot subject after walking with the assembled footwear for 10-60 minutes. In another embodiment, short term immediate effect is apparent in a barefoot subject after walking with the assembled footwear for 30-600 minutes. In another embodiment, short term immediate effect is apparent in a barefoot subject after walking with the assembled footwear for 1-10 hours (hrs). In another embodiment, short term immediate effect is apparent in a barefoot subject after walking with the assembled footwear for 5-1000 hours (hrs). In another embodiment, short term immediate effect is apparent in a barefoot subject after walking with the assembled footwear for 12-96 hours (hrs). In another embodiment, short term immediate effect is apparent in a barefoot subject after walking with the assembled footwear for 1-10 days. In another embodiment, short term immediate effect is apparent in a barefoot subject after walking with the assembled footwear for 7-21 days. In another embodiment, short term immediate effect is apparent in a barefoot subject after walking with the assembled footwear for 5-30 days. Each possibility represents a separate embodiment of the present invention.

In another embodiment, the effect is apparent in a barefoot subject after walking with the assembled footwear for 1-2 months. In another embodiment, the effect is apparent in a barefoot subject after walking with the assembled footwear for 1-24 months. In another embodiment, the effect is apparent in a barefoot subject after walking with the assembled footwear for 2-6 months. In another embodiment, the effect is apparent in a barefoot subject after walking with the assembled footwear for 4-10 months. In another embodiment, the effect is apparent in a barefoot subject after walking with the assembled footwear for 6-48 months. In another embodiment, the effect is apparent in a barefoot subject after walking with the assembled footwear for 12-24 months. In another embodiment, the effect is apparent in a barefoot subject after walking with the assembled footwear for 10-30 months. Each possibility represents a separate embodiment of the present invention.

In another embodiment, treating is a process wherein the subject's disease or condition is ameliorated. In another embodiment, treating is improvement over time. In another embodiment, treating is continuous improvement over time. In another embodiment, progress or improvement is reduction in any measure provided herein. In another embodiment, progress or improvement is measured in a gait lab. In another embodiment, progress or improvement is measured by radiological methods. In another embodiment, radiological methods for measuring progress, treatment and/or improvement are known to one of skill in the art (such as but not limited to: X-ray, MRI, etc.). In another embodiment, progress or improvement is measured by a pain questionnaire. In another embodiment, progress or improvement is measured by physical examination that includes examining a range of motions such as but not limited to: flexion, extension, dorsi/plantar flexion (ankle), muscular circumference, internal/external rotation (hip) abduction/adduction (hip and knee), effusion, hot/warm knee, or any combination thereof. In another embodiment, progress or improvement is measured by visual clinical gait assessment. Each possibility represents a separate embodiment of the present invention.

In another embodiment, progress or improvement is measured in a gait lab and includes measuring velocity, step length increase, step length difference (symmetry), single limb support (aim at reaching 40%), single limb support difference (symmetry), double limb support, in-toeing/out-toeing, flexion/extension, range of motion (rom), flexion/extension, or any combination thereof. Each possibility represents a separate embodiment of the present invention.

In another embodiment, an assembled footwear as described herein is prescribed to a subject according to the subject's physical condition. In another embodiment, an assembled footwear as described herein is prescribed to a subject according to the subject's medical condition. In another embodiment, an assembled footwear as described herein is prescribed to a subject according to the subject's medical history. In another embodiment, prescription includes directions of how to use the assembled footwear and more precisely which perturbances to assemble in the outsole of the assembled footwear. In another embodiment, prescription includes intensity of use, daily use, or daily distance directions. In another embodiment, prescription to a subject having step length of 45 cm or less comprises usage of the assembled footwear by walking for 10-40 minutes a day. In another embodiment, prescription to a subject having step length of 45 cm or less comprises usage of the assembled footwear by walking for 10-40 minutes every other day. Each possibility represents a separate embodiment of the present invention.

In another embodiment, medium prescription applies to subjects having step length of 45-60 cm. In another embodiment, medium prescription applies to subjects having step length of 50-60 cm. In another embodiment, medium prescription applies to subjects having step length of 60-65 cm. In another embodiment, medium prescription comprises usage of the assembled footwear by walking for 5-20 minutes a day. In another embodiment, medium prescription comprises usage of the assembled footwear by walking for 10-20 minutes a day. In another embodiment, medium prescription comprises usage of the assembled footwear by walking for 5-15 minutes a day. Each possibility represents a separate embodiment of the present invention.

In another embodiment, high prescription applies to subjects having step length of 65 cm and above. In another embodiment, high prescription applies to subjects having step length of 60 cm and above. In another embodiment, high prescription comprises usage of the assembled footwear by walking for 5-20 minutes a day. In another embodiment, high prescription comprises usage of the assembled footwear by walking for 10-20 minutes a day. In another embodiment, high prescription comprises usage of the assembled footwear by walking for 5-15 minutes a day. Each possibility represents a separate embodiment of the present invention.

In another embodiment, any prescription as described herein comprises increase in daily usage time as the subject's step length improves. In another embodiment, any prescription as described herein comprises increase in daily usage time as the subject's functional level improves. In another embodiment, any prescription as described herein comprises increase in daily usage time as subject's pain decreases. In another embodiment, any prescription as described herein comprises increase in daily usage time as subject's disease or condition as described herein, improves. In another embodiment, a prescription as described herein further comprises medicating the subject according to his or hers medical condition. Each possibility represents a separate embodiment of the present invention.

In another embodiment, a prescription as described herein further comprises a selection of new set of perturbances as subject's disease or condition improved or deteriorates.

Additional objects, advantages, and novel features of the present invention will become apparent to one ordinarily skilled in the art upon examination of the following examples, which are not intended to be limiting. Additionally, each of the various embodiments and aspects of the present invention as delineated hereinabove and as claimed in the claims section below finds experimental support in the following examples.

The invention claimed is:

1. A footwear for manipulating a gait parameter, comprising, an outsole, comprising:

at least one recess located at a ground engaging or outer surface of the outsole and having:

(a) a depth of between 10% to 95% of the maximum thickness of the outsole; and (b) an area that covers between 10% to 95% of the entire ground engaging or outer surface of the outsole; and one or more curved protuberances, protruding out from said ground engaging or outer surface of said outsole, wherein a base side of said one or more protuberances occupy between 50% and 95% of an area of the at least one recess, and adapted to be removably inserted into said at least one recess via two or more connectors fixating each protuberance to said at least one recess.

2. The footwear of claim 1, wherein the two curved protuberances are asymmetrical.

3. The footwear of claim 1, wherein the two curved protuberances are defined by a variety of arches of different radiuses which are tangent to each other.

4. The footwear of claim 1, wherein an outer contour of at least one of said two curved protuberances and an outer contour of said outsole form a continuous curvature.

5. The footwear of claim 1, wherein each curved protuberance comprises a portion connectable to the recess and a ground-engaging portion, wherein the portion connectable to the recess is harder than the ground-engaging portion.

6. The footwear of claim 1, wherein each protuberance is different with respect to at least a location of the peak, a convexity, shore-hardness, or any combination thereof.

7. The footwear of claim 1, wherein a base of a single protuberance occupies at least 60% of an area of a single recess and a first perimeter of said base of said single protuberance is adapted to fit a second perimeter of said single recess.

8. The footwear of claim 1, wherein for each protuberance at least a location of a peak is determined based on at least one gait parameter and/or the balance of the subject measured for a group of subjects.

9. The footwear of claim 8, wherein the gait parameters are selected from: foot alignment, knee alignment, velocity, swing and stance phase, double support time, ground reaction forces, impulse, propulsion during habitual walking, kneed alignment, center of pressure, symmetry, gait speed, step time, step length, stride length, step width, foot angle, demarcation between walking and running.

10. The footwear of claim 8, wherein the group of subjects are determined as subjects having at least two common characteristics, selected from, age, gender, foot size, gait behavior and pathology.

11. The footwear of claim 10, wherein subjects having the common gait behaviour are subjects having at least two similar gait parameters.

12. The footwear of claim 8, wherein for each protuberance a curvature of the protuberance is determined based on the at least one gait parameter and/or the balance parameter of the subject measured for the group of subjects.

13. The footwear of claim 8, wherein for each protuberance a contour of a base of the protuberance is determined based on the at least one gait parameter and/or the balance parameter of the subject measured for the group of subjects.

14. A footwear kit for manipulating a gait parameter, comprising:

the footwear comprising an outsole, comprising:

at least one recess located at a ground engaging or outer surface of the outsole and having:

(a) a depth of between 10% to 95% of the maximum thickness of the outsole; and (b) an area that covers between 10% to 95% of the entire ground engaging or outer surface of the outsole; and one or more curved protuberances protruding out from said ground engaging or outer surface of said outsole, wherein a base side of said one or more protuberances occupies between 50% and 95% of an area of the at least one recess, and adapted to be removably inserted into said at least one recess via two or more connectors fixating each protuberance to said at least one recess.

15. The footwear kit of claim 14, wherein said two curved protuberances at their peak are higher in at least 10% than a maximum depth of said at least one recess.

16. The footwear kit of claim 14, wherein the two curved protuberances are asymmetrical.

17. The footwear kit of claim 14, wherein the two curved protuberances are defined by a variety of arches of different radiuses which are tangent to each other.

18. The footwear kit of claim 14, wherein an outer contour of at least one of said two curved protuberances and an outer contour of said outsole form a continuous curvature.

19. The footwear kit of claim 14, wherein each curved protuberance comprises a portion connectable to the recess and a ground-engaging portion, wherein the portion connectable to the recess is harder than the ground-engaging portion.

20. The footwear kit of claim 14, wherein each protuberance is different with respect to at least the location of the peak, a convexity, shore-hardness, or any combination thereof.

* * * * *